US012571117B2

(12) United States Patent
Suzuki et al.

(10) Patent No.: US 12,571,117 B2
(45) Date of Patent: Mar. 10, 2026

(54) OPERATION SUPPORT METHOD, OPERATION SUPPORT DEVICE, OPERATION SUPPORT SYSTEM, AND OPERATION SUPPORT PROGRAM

(71) Applicant: ASAHI KASEI KABUSHIKI KAISHA, Tokyo (JP)

(72) Inventors: Yuto Suzuki, Tokyo (JP); Takeaki Sasaki, Tokyo (JP); Shingo Fukuchi, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 696 days.

(21) Appl. No.: 17/980,501

(22) Filed: Nov. 3, 2022

(65) Prior Publication Data

US 2023/0047541 A1 Feb. 16, 2023

Related U.S. Application Data

(63) Continuation of application No. PCT/JP2021/021467, filed on Jun. 4, 2021.

(30) Foreign Application Priority Data

Jul. 15, 2020 (JP) ..... 2020-121700

(51) Int. Cl.
*C25B 15/023* (2021.01)
*C25B 1/46* (2006.01)

(52) U.S. Cl.
CPC ..... *C25B 15/023* (2021.01); *C25B 1/46* (2013.01)

(58) Field of Classification Search
None
See application file for complete search history.

(56) References Cited

U.S. PATENT DOCUMENTS

2001/0039481 A1 11/2001 Tremblay
2005/0011766 A1 1/2005 Tojo
(Continued)

FOREIGN PATENT DOCUMENTS

CN 107059052 A 8/2017
JP H06190366 A 7/1994
(Continued)

OTHER PUBLICATIONS

International Search Report and (ISA/237) Written Opinion of the International Search Authority for International Patent Application No. PCT/JP2021/021467, issued/mailed by the Japan Patent Office on Aug. 24, 2021.
(Continued)

*Primary Examiner* — Alexander W Keeling

(57) ABSTRACT

Provided is an operation support method including: acquiring instrument information including measurement data from an instrument included in an electrolytic apparatus; acquiring switching portion information indicating information regarding switching portions included in the electrolytic apparatus; acquiring electrolytic apparatus state information indicating a state of the electrolytic apparatus on the basis of at least one of the instrument information or the switching portion information; and displaying by a display unit controlled by a control unit to display the electrolytic apparatus state information acquired by the electrolytic apparatus state acquisition unit.

23 Claims, 17 Drawing Sheets

100

(56) References Cited

U.S. PATENT DOCUMENTS

| | | | | |
|---|---|---|---|---|
| 2009/0071843 | A1* | 3/2009 | Miyashita | C02F 1/4618 204/229.8 |
| 2016/0369416 | A1 | 12/2016 | Mermelstein | |
| 2020/0263310 | A1* | 8/2020 | Ua Cearnaigh | C25B 1/34 |
| 2023/0047541 | A1 | 2/2023 | Suzuki | |

FOREIGN PATENT DOCUMENTS

| | | | |
|---|---|---|---|
| JP | H07299442 | A | 11/1995 |
| JP | 2007031739 | A | 2/2007 |
| JP | 2013193019 | A | 9/2013 |
| JP | 2018131647 | A | 8/2018 |
| JP | 2019167564 | A | 10/2019 |
| WO | 2020050284 | A1 | 3/2020 |
| WO | 2020129557 | A1 | 6/2020 |

OTHER PUBLICATIONS

Supplementary European Search Report for counterpart European Application No. 21843512.1, issued by the European Patent Office on Jul. 2, 2024.

* cited by examiner

50

50

300

OPERATION SUPPORT METHOD, OPERATION SUPPORT DEVICE, OPERATION SUPPORT SYSTEM, AND OPERATION SUPPORT PROGRAM

The contents of the following Japanese patent application(s) are incorporated herein by reference:

NO. 2020-121700 filed in JP on Jul. 15, 2020

NO. PCT/JP2021/021467 filed in WO on Jun. 4, 2021

BACKGROUND

1. Technical Field

The present invention relates to an operation support method, an operation support device, an operation support system, and an operation support program.

2. Related Art

Patent document 1 relates to a method and a device for capturing, monitoring, displaying, and diagnosing operation parameters of an electrolysis apparatus. Patent document 1 describes that "A monopolar electrolyzer is hereinafter considered as a single cell unit, and a bipolar electrolyzer is considered as a plurality of unit cells. The reading of a voltage is measured for each unit cell. The present invention enables the detection of faults and events in each unit cell" (paragraph 0014).

CITATION LIST

Patent Document

Patent Document 1: Japanese translation publication of a PCT route patent application No.

DESCRIPTION OF EXEMPLARY EMBODIMENTS

Hereinafter, the invention will be described through embodiments of the invention, but the following embodiments do not limit the invention according to claims. In addition, not all of the combinations of features described in the embodiments are essential to the solving means of the invention.

Figure 1:
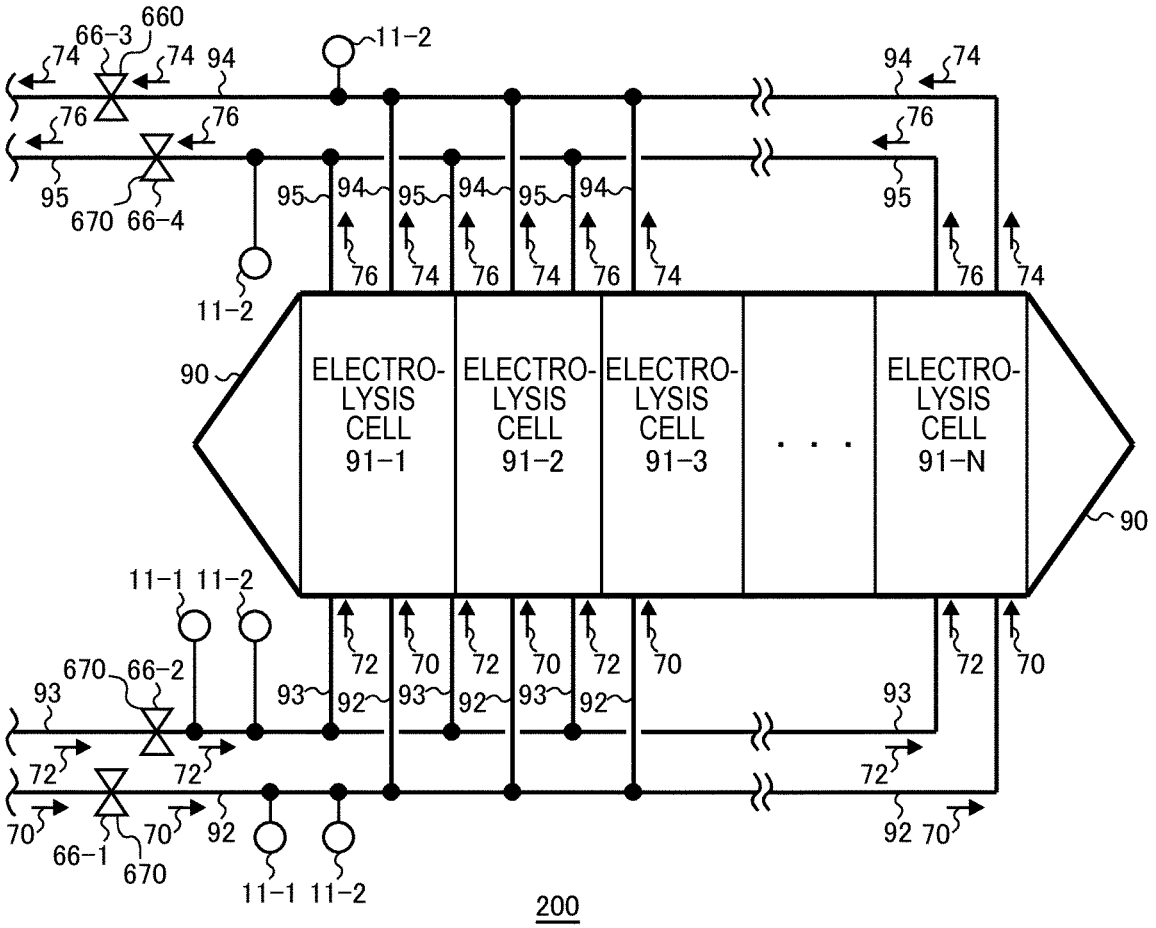
FIG. 1 shows an example of an electrolytic apparatus 200 according to one embodiment of the present invention.

FIG. 1 shows an example of an electrolytic apparatus 200 according to one embodiment of the present invention. The electrolytic apparatus 200 of the present example includes an electrolyzer 90, an introduction tube 92, an introduction tube 93, a discharge tube 94, a discharge tube 95, and one or more switching portions 66. The electrolytic apparatus 200 of the present example includes four switching portions 66 (switching portions 66-1 to 66-4). In the present example, the switching portion 66-1 to the switching portion 66-4 are provided in the introduction tube 92, the introduction tube 93, the discharge tube 94, and the discharge tube 95, respectively. The switching portion 66 is, for example, a valve.

The electrolytic apparatus 200 is an apparatus that electrolyzes an electrolytic solution. In the present example, the electrolytic apparatus 200 is an apparatus that generates Cl (chlorine) and NaOH (sodium hydroxide) by electrolyzing an aqueous solution of NaCl (sodium chloride). A product produced by the generation with the electrolytic apparatus 200 is defined as a product P. The electrolyzer 90 is a tank for electrolyzing an electrolytic solution. The electrolyzer 90 in the present example is a tank for electrolyzing an aqueous solution of NaCl (sodium chloride). The electrolyzer 90 may include a plurality of electrolysis cells 91 (electrolysis cells 91-1 to 91-N, where N is an integer of 2 or more). N is, for example, 50. Note that the electrolytic apparatus 200 may be an apparatus that generates $H_2$ (hydrogen) and $O_2$ (oxygen) by electrolyzing $H_2O$ (water). The electrolyzer 90 may be a tank that electrolyzes $H_2O$ (water).

The introduction tube 92 and the introduction tube 93 are connected to the electrolyzer 90. In the present example, the introduction tube 92 and the introduction tube 93 are connected to each of the electrolysis cell 91-1 to the electrolysis cell 91-N. Liquid 70 is introduced into each of the electrolysis cells 91-1 to 91-N. The liquid 70 may be introduced into each of the electrolysis cells 91-1 to 91-N after passing through the introduction tube 92. In the present example, the liquid 70 is an aqueous solution of NaCl (sodium chloride). Liquid 72 is introduced into each of the electrolysis cells 91-1 to 91-N. The liquid 72 may be introduced into each of the electrolysis cells 91-1 to 91-N after passing through the introduction tube 93. The liquid 72 may be an aqueous solution of NaOH (sodium hydroxide) or may be an aqueous solution of KOH (potassium hydroxide).

The discharge tube 94 and discharge tube 95 are connected to the electrolyzer 90. In the present example, the discharge tube 94 and the discharge tube 95 are connected to each of the electrolysis cell 91-1 to the electrolysis cell 91-N. Liquid 74 and gas 77 (described below) are derived from the electrolyzer 90.

The electrolytic apparatus 200 may include a separation device that separates the liquid 74 and the gas 77 (described below). The liquid 74 and the gas 77 (described below) may be separated into the liquid 74 and the gas 77 (described below) by the separation device after passing through the discharge tube 94. The separated liquid 74 may be reused to generate the liquid 70 outside the electrolytic apparatus 200 or may be discarded. In the present example, the liquid 74 is an aqueous solution of NaCl (sodium chloride). The gas 77 (described below) may be collected as a product outside the electrolytic apparatus 200. In the present example, the gas 77 (described below) is $Cl_2$ (chlorine).

Liquid 76 and gas 78 (described below) are derived from the electrolyzer 90. The liquid 76 and the gas 78 (described below) may be separated into the liquid 76 and the gas 78 (described below) by the separation device described above after passing through the discharge tube 95. The separated liquid 76 may be collected as a product outside the electrolytic apparatus 200. In the present example, the liquid 76 is an aqueous solution of NaOH (sodium hydroxide). The gas 78 (described below) may be collected as a product outside the electrolytic apparatus 200 or may be discarded. In the present example, the gas 78 (described below) is $H_2$ (hydrogen).

The switching portion 66-1 controls a flow rate of the liquid 70 flowing through the introduction tube 92. The switching portion 66-1 may control a flow rate per unit time of the liquid 70 flowing through the introduction tube 92 or an integrated value of the flow rate over a predetermined time. The switching portion 66-2 controls a flow rate of the liquid 72 flowing through the introduction tube 93. The switching portion 66-2 may control a flow rate per unit time of the liquid 72 flowing through the introduction tube 93 or an integrated value of the flow rate over a predetermined time. The switching portion 66-3 controls the pressure of the gas 77 (described below) flowing through the discharge tube 94. The switching portion 66-4 controls the pressure of the gas 78 (described below) flowing through the discharge tube 95.

In the present example, instruments 11 are provided in the introduction tube 92, the introduction tube 93, the discharge tube 94, and the discharge tube 95. In the present example, an instrument 11-1 is a pressure gauge, an instrument 11-2 is a flow instrument, and an instrument 11-3 (described below) is a level gauge. The instruments 11-1 may be provided in the introduction tube 92 and the introduction tube 93. The instruments 11-2 may be provided in the introduction tube 92, the introduction tube 93, the discharge tube 94, and the discharge tube 95.

The instrument 11-1 provided in the introduction tube 92 may measure the pressure of a chlorine gas ($Cl_2$) in an anode chamber 79 (described below). The instrument 11-1 provided in the introduction tube 93 may measure the pressure of a hydrogen gas ($H_2$) in a cathode chamber 98 (described below).

The instrument 11-2 provided in the introduction tube 92 may measure a flow rate per unit time of the liquid 70 flowing through the introduction tube 92. The instrument 11-2 provided in the introduction tube 93 may measure a flow rate per unit time of the liquid 72 flowing through the introduction tube 93. The instrument 11-2 provided in the discharge tube 94 may measure a flow rate per unit time of the liquid 74 flowing through the discharge tube 94. The instrument 11-2 provided in the discharge tube 95 may measure a flow rate per unit time of the liquid 76 flowing through the discharge tube 95.

As described below, in the present example, at least one of the switching portion 66-1 to the switching portion 66-4 may be a manual manipulation target switching portion 660. The manual manipulation target switching portion 660 is a switching portion 66 that is a target to be manually manipulated by the operator. The switching portion 66 other than the manual manipulation target switching portion 660 may be an automatic control target switching portion 670. The automatic control target switching portion 670 is switching portion 66 that is a target of automatic control in the electrolytic apparatus 200 and is a target of automatic control by the operation support device 100 (described below).

When the pressure measured by the instrument 11-1 is less than a predetermined pressure, the flow rate measured by the instrument 11-2 is less than a predetermined flow rate, and the liquid level measured by the instrument 11-3 (described below) is less than a predetermined liquid level height, the switching portion 66 is operating normally. When the switching portion 66 is operating normally, all the switching portions 66 are the automatic control target switching portions 670. FIG. 1 is an example of a case where the switching portion 66-3 is the manual manipulation target switching portion 660, and the switching portion 66-1, the switching portion 66-2, and the switching portion 66-4 are the automatic control target switching portions 670.

Figure 2:
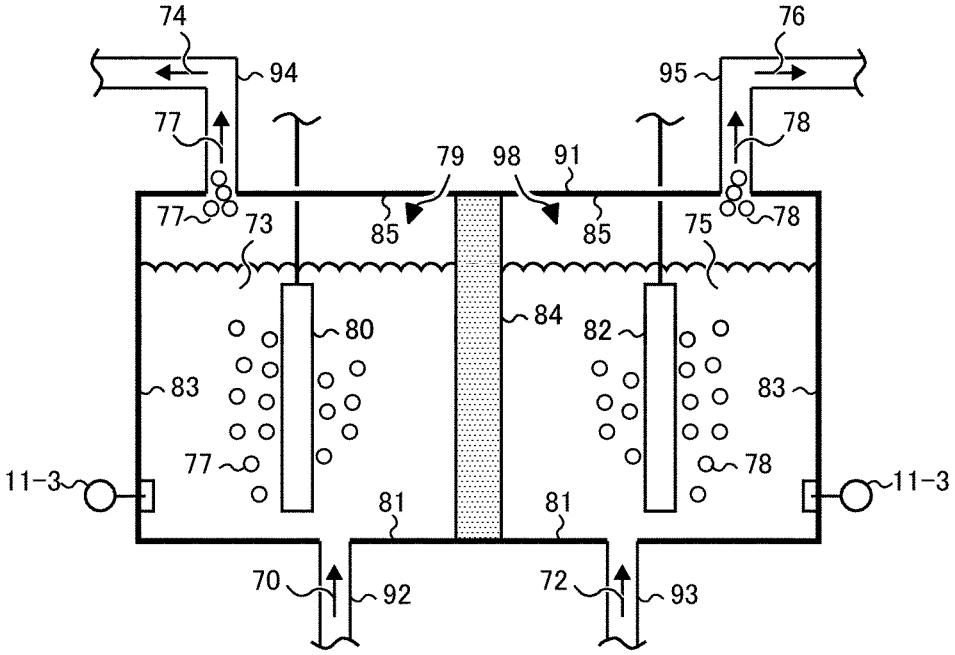
FIG. 2 shows an example of details of one electrolysis cell 91 in FIG. 1.

FIG. 2 shows an example of details of one electrolysis cell 91 in FIG. 1. The electrolysis cell 91 of the present example includes an anode 80, a cathode 82, and an ion exchange membrane 84. The anode chamber 79 and the cathode chamber 98 are provided inside the electrolysis cell 91. The ion exchange membrane 84 partitions the anode chamber 79 and the cathode chamber 98. The anode 80 is arranged in the anode chamber 79. The cathode 82 is arranged in the cathode chamber 98. The introduction tube 92 and the discharge tube 94 are connected to the anode chamber 79. The introduction tube 93 and the discharge tube 95 are connected to the cathode chamber 98.

The ion exchange membrane 84 is a membrane-shaped substance that prevents passage of ions having a sign different from that of the ions arranged in the ion exchange membrane 84 and allows passage of only ions having the same sign. In the present example, the ion exchange membrane 84 is a membrane that allows $Na^+$ (sodium ions) to pass and prevents $Cl^-$ (chlorine ions) from passing.

The electrolysis cell 91 has a bottom surface 81, an inner side surface 83, and a ceiling surface 85. The anode chamber 79 and the cathode chamber 98 are spaces surrounded by the bottom surface 81, the inner side surface 83, and the ceiling surface 85.

The anode 80 and the cathode 82 may be maintained at predetermined positive and negative potentials, respectively. The liquid 70 introduced into anode chamber 79 and the liquid 72 introduced into cathode chamber 98 are electrolyzed by a potential difference between the anode 80 and the cathode 82. In the anode 80, the following chemical reaction occurs.

$$2Cl^- \rightarrow Cl_2 + 2e^- \quad \text{[Chemical Formula 1]}$$

When the liquid 70 is NaCl (sodium chloride), NaCl (sodium chloride) is ionized into $Na^+$ (sodium ion) and $Cl^-$ (chlorine ion). In the anode 80, a chlorine gas ($Cl_2$) is generated by the chemical reaction represented by Chemical Formula 1. $Na^+$ (sodium ions) moves from the anode chamber 79 to the cathode chamber 98 via the ion exchange membrane 84 by an attractive force from the cathode 82.

In the anode chamber 79, liquid 73 may be retained. The liquid 73 in the present example is an aqueous solution of NaCl (sodium chloride). The $Na^+$ (sodium ion) concentration and the $Cl^-$ (chlorine ion) concentration of the liquid 73 may be less than the $Na^+$ (sodium ion) concentration and the $Cl^-$ (chlorine ion) concentration of the liquid 70.

In the cathode 82, the following chemical reaction occurs.

$$2H_2O+2e^- \rightarrow H_2+2OH^- \quad \text{[Chemical Formula 2]}$$

In the cathode 82, a hydrogen gas ($H_2$) and a hydroxide ion (OH) are generated by the chemical reaction represented by Chemical Formula 2. In the cathode chamber 98, liquid 75 in which hydroxide ions (OH) generated by the chemical reaction represented by Chemical Formula 2 and $Na^+$ (sodium ions) moved from the anode chamber 79 are dissolved may be retained. The liquid 75 in the present example is an aqueous solution of NaOH (sodium hydroxide).

The instruments 11-3 may be provided in the anode chamber 79 and the cathode chamber 98. In the present example, the instrument 11-3 is a level gauge. The instrument 11-3 may be a limit switch. The limit switch is a switch having a microswitch built in, and is a switch in which the microswitch is incorporated in a sealing case or the like that protects the microswitch from $H_2O$ (water) or the like. The limit switch is a switch configured to operate even under an environment where mechanical stress or the like is received from the outside of the limit switch.

In the present example, the instrument 11-3 provided in the anode chamber 79 senses whether the liquid level of the liquid 73 in the anode chamber 79 has reached the predetermined liquid level height. In the present example, the instrument 11-3 provided in the cathode chamber 98 senses whether the liquid level of the liquid 75 in the cathode chamber 98 has reached the predetermined liquid level height.

Figure 3:
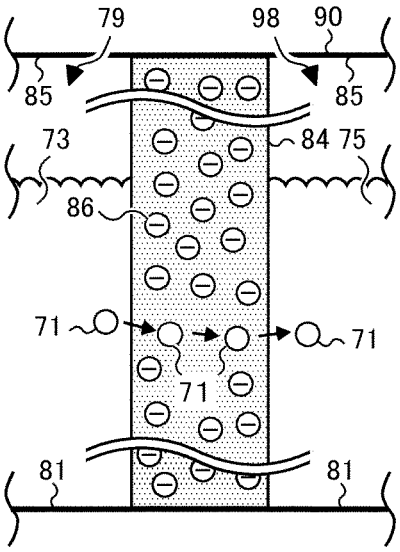
FIG. 3 is a diagram showing a vicinity of an ion exchange membrane 84 in the electrolysis cell 91 shown in FIG. 2 to an enlarged scale.

FIG. 3 is a diagram showing the vicinity of the ion exchange membrane 84 in the electrolysis cell 91 shown in FIG. 2 to an enlarged scale. An anion group 86 is fixed to the ion exchange membrane 84 of the present example. Since anions are repelled by the anion group 86, the anions hardly pass through the ion exchange membrane 84. In the present example, the anions are $Cl^-$ (chlorine ion). Since cations 71 are not repelled by the anion group 86, the cations can pass through the ion exchange membrane 84. In the present example, the cations 71 are $Na^+$ (sodium ion).

Figure 4:
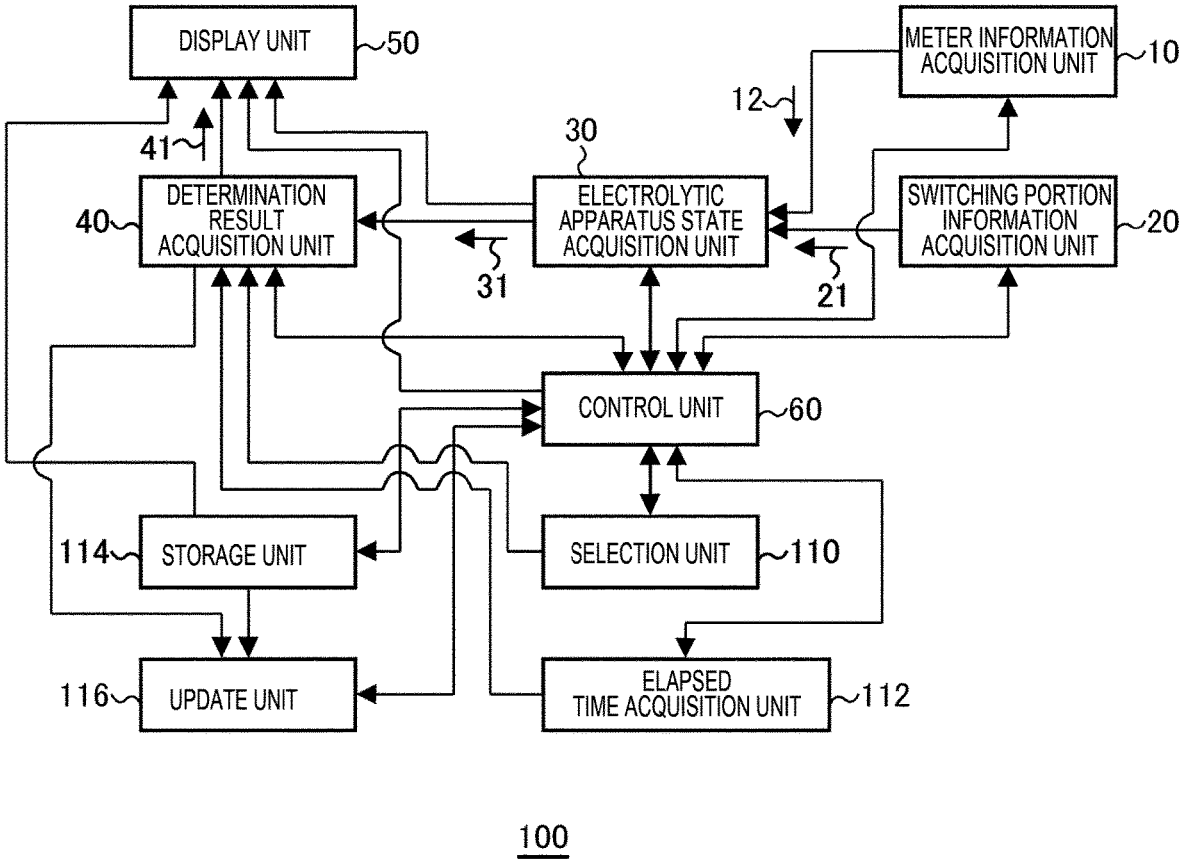
FIG. 4 shows an example of a block diagram of an operation support device 100 according to one embodiment of the present invention.

FIG. 4 shows an example of a block diagram of the operation support device 100 according to one embodiment of the present invention. The operation support device 100 supports the operation of the electrolytic apparatus 200 (see FIG. 1). The operation support device 100 includes an instrument information acquisition unit 10, a switching portion information acquisition unit 20, an electrolytic apparatus state acquisition unit 30, a determination result acquisition unit 40, and a control unit 60.

The operation support device 100 is, for example, a computer including a CPU, a memory, an interface, and the like. The control unit 60 may be the CPU. When the operation support device 100 is a computer, an operation support program for executing an operation support method to be described below may be installed in the computer, and an operation support program for causing the computer to function as the operation support device 100 may be installed in the computer. Note that the computer may be a tablet computer.

The operation support device 100 may or may not include a display unit 50, a selection unit 110, an elapsed time acquisition unit 112, a storage unit 114, and an update unit 116. The operation support device 100 of the present example includes the display unit 50, the selection unit 110, the elapsed time acquisition unit 112, the storage unit 114, and the update unit 116. When the operation support device 100 does not include the display unit 50 and the storage unit 114, the display unit 50 and the storage unit 114 separate from the operation support device 100 may be connected to the operation support device 100 via a predetermined interface.

The instrument information acquisition unit 10 acquires instrument information 12 from the instrument 11 (see FIGS. 1 and 2) included in the electrolytic apparatus 200. The instrument information 12 is measurement data by the instrument 11. The measurement data is data obtained by measuring parameters regarding the electrolytic apparatus 200. The parameters may include the flow rates of the liquid 70 (see FIG. 1) and the liquid 72 (see FIG. 1) and the flow rates of the liquid 74 (see FIG. 1) and the liquid 75 (see FIG. 1). The parameters may include the liquid level height of the liquid 73 (see FIG. 2) in the anode chamber 79 and the pressure of the gas 77 (see FIG. 2). The parameters may include the liquid level height of the liquid 75 (see FIG. 2) in the cathode chamber 98 and the pressure of the gas 78 (see FIG. 2).

The switching portion information acquisition unit 20 acquires switching portion information 21 indicating information regarding the switching portion 66. The switching portion 66 controls at least one of the flow rate of fluid or the pressure of gas. The fluid may be at least any one of the liquid 70 (see FIG. 1), the liquid 72 (see FIG. 1), the liquid 74 (see FIG. 1), or the liquid 76 (see FIG. 1). The gas may be at least one of the gas 77 (see FIG. 2) or the gas 78 (see FIG. 2).

The switching portion information 21 may refer to information indicating whether the switching portion 66 is in an open state or a closed state or may refer to information indicating whether the switching portion 66 is in an intermediate state between the open state and the closed state. The switching portion information 21 may refer to information on the time required for the switching portion 66 to switch from the open state to the closed state or from the closed state to the open state.

The electrolytic apparatus state acquisition unit 30 acquires electrolytic apparatus state information 31 indicating the state of the electrolytic apparatus 200 (see FIG. 1). The electrolytic apparatus state acquisition unit 30 acquires the electrolytic apparatus state information 31 on the basis of at least one of the instrument information 12 or the switching portion information 21. The state of the electrolytic apparatus 200 may further include process information indicating which process the electrolytic apparatus 200 is currently in.

The state of the electrolytic apparatus 200 refers to whether the electrolytic apparatus 200 requires the work by an operator. In the present example, the state of not requiring the work by the operator is a case where the electrolytic apparatus 200 is in a normal state. In the present example, a case where the electrolytic apparatus 200 is in the normal state is a case where the pressure measured by the instrument 11-1 is less than the predetermined pressure, the flow rate measured by the instrument 11-2 is less than the predetermined flow rate, and the liquid level measured by the instrument 11-3 is less than the predetermined liquid level height, so that the switching portion 66 is operating normally.

In the present example, the state of requiring the work by the operator includes a case where the electrolytic apparatus 200 is in the normal state and a case where the electrolytic apparatus is in an abnormal state. A state where the electrolytic apparatus 200 is in the normal state and requires the work by the operator refers to predetermined work by the operator, for example, in the case of a leak test or the like of the ion exchange membrane 84.

A case where the electrolytic apparatus 200 is in the abnormal state refers to a state where the electrolytic apparatus 200 is not automatically controlled due to occurrence of some abnormality in the electrolytic apparatus 200. The abnormal state may include a state where the switching portion 66 is not fully opened or fully closed, and may include a state where the opening/closing speed of the switching portion 66 is lower than a predetermined speed. The abnormal state may include a state where a time required to execute each process in one or more predetermined processes exceeds a predetermined allowable time, a state where a pressure of at least one of the gas 77 (see FIG. 2) or the gas 78 (see FIG. 2) exceeds a predetermined pressure, and a state where a flow rate of at least one of the liquid 70 (see FIG. 1), the liquid 72 (see FIG. 1), the liquid 74 (see FIG. 1), or the liquid 76 (see FIG. 1) exceeds a predetermined flow rate. The abnormal state may include a case where a pressure difference between the anode chamber 79 and the cathode chamber 98 is equal to or larger than a predetermined allowable pressure difference. The abnormal state may include a case where at least one of the liquid level height of the liquid 73 in the anode chamber 79 or the liquid level height of the liquid 75 in the cathode chamber 98 is equal to or higher than a predetermined liquid level height. The abnormal state may include a case where a difference between the liquid level height of the liquid 73 in the anode chamber 79 and the liquid level height of the liquid 75 in the cathode chamber 98 is equal to or larger than a predetermined allowable difference.

The introduction tube 92 may be provided with a plurality of instruments 11-1, and the introduction tube 93 may be provided with a plurality of instruments 11-1. The introduction tube 92 may be provided with a plurality of instruments 11-2, and the introduction tube 93 may be provided with a plurality of instruments 11-2. The discharge tube 94 may be provided with a plurality of instruments 11-2, and the discharge tube 95 may be provided with a plurality of instruments 11-2.

For example, when two instruments 11-1 are provided in the introduction tube 92, the electrolytic apparatus state acquisition unit 30 may acquire the electrolytic apparatus state information 31 on the basis of a difference between the pressures measured by the two instruments 11-1. The electrolytic apparatus state information 31 may include information that the electrolytic apparatus 200 is in the normal state and information that the electrolytic apparatus 200 is in the abnormal state.

The work by the operator refers to the manual work by the operator. The target of the work by the operator may include at least one switching portion 66 and the electrolyzer 90. The work by the operator may include at least any one of the manipulation of the manual manipulation target switching portion 660 (see FIG. 1), the confirmation for the electrolytic apparatus 200, or the confirmation for the components of the electrolytic apparatus 200. The manipulation of the manual manipulation target switching portion 660, the confirmation for the electrolytic apparatus 200, and the confirmation for the components of the electrolytic apparatus 200 may be predetermined work by the operator when the electrolytic apparatus 200 is not in the abnormal state. In the present example, the manual manipulation target switching portion 660 is at least one of the switching portion 66-1 to the switching portion 66-4.

The confirmation for the electrolytic apparatus 200 may include confirmation work on whether at least one of the liquid 73 or the liquid 75 is leaking from the electrolyzer 90. The confirmation for the components of the electrolytic apparatus 200 may include confirmation work on whether there is no damage in the ion exchange membrane 84. The confirmation work on whether there is no damage in the ion exchange membrane 84 may include work of detaching a nozzle arranged at an outlet on the cathode 82 side of the ion exchange membrane 84 of the electrolysis cell 91, application of soap water to the nozzle, confirmation of swelling of foam of the soap water, and the like.

The control unit 60 controls acquisition of the instrument information 12 by the instrument information acquisition unit 10. The control unit 60 controls acquisition of the switching portion information 21 by the switching portion information acquisition unit 20. The control unit 60 controls acquisition of the electrolytic apparatus state information 31 by the electrolytic apparatus state acquisition unit 30.

The state of the electrolytic apparatus 200 requiring the work by the operator is defined as a first state S1 of the electrolytic apparatus 200. As described above, the first state S1 includes a case where the electrolytic apparatus 200 is in the normal state and a case where the electrolytic apparatus is in the abnormal state. The state of the electrolytic apparatus 200 not requiring the work by the operator is defined as a second state S2 of the electrolytic apparatus 200. As described above, in the present example, the second state S2 is a case where the pressure measured by the instrument 11-1 is less than the predetermined pressure, the flow rate measured by the instrument 11-2 is less than the predetermined flow rate, and the liquid level measured by the instrument 11-3 is less than the predetermined liquid level height, so that the switching portion 66 is operating normally.

When the electrolytic apparatus 200 is in the first state S1, the control unit 60 does not control at least one of the switching portions 66, and controls the display unit 50 such that the display unit 50 performs display to prompt a work by the operator. When electrolytic apparatus 200 is in the second state S2, the control unit 60 controls all switching portions 66.

When the electrolytic apparatus state information 31 is in a predetermined first condition C1, the determination result acquisition unit 40 acquires a determination result 41 that it is determined that the state of the electrolytic apparatus 200 is the first state S1. When the electrolytic apparatus state information 31 is in a predetermined second condition C2, the determination result acquisition unit 40 acquires the determination result 41 that it is determined that the state of the electrolytic apparatus 200 is the second state S2. The first condition C1 and the second condition C2 are different.

The first condition C1 may be the state of the electrolytic apparatus 200 in which predetermined work by the operator is assumed. For example, the first condition C1 is the manual confirmation or the like for the electrolyzer 90 by the operator when the pressure of at least one of the gas 77 or the gas 78 is equal to or higher than a predetermined pressure Pr.

The second condition C2 may be a condition that satisfies a predetermined standard Std to be described below. For example, as described below, when the standard Std is the predetermined pressure Pr of at least one of the gas 77 or the gas 78 or when the standard Std is a predetermined pressure difference Dpr between the gas 77 and the gas 78, the electrolytic apparatus state information 31 satisfies the second condition C2 (satisfies the standard Std).

Figure 5:
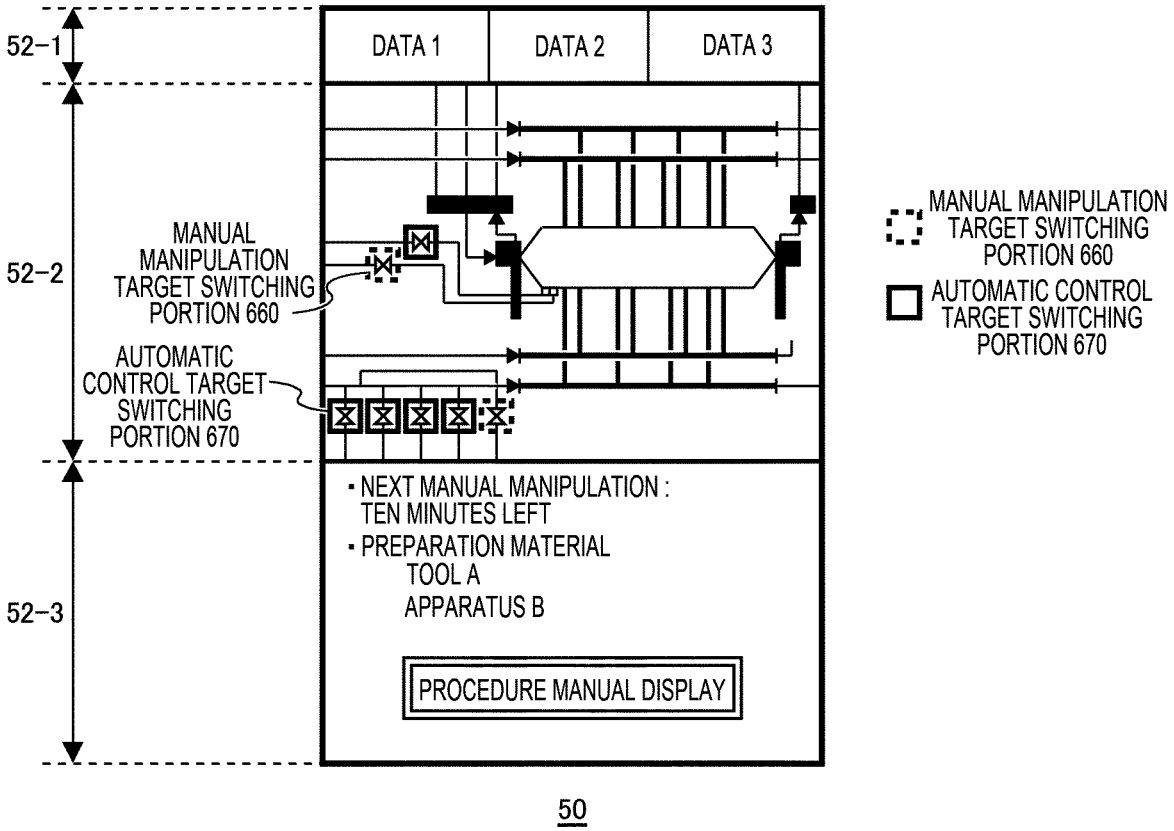
FIG. 5 shows an example of a display unit 50.

FIG. 5 shows an example of the display unit 50. The display unit 50 is, for example, a monitor, a display, or the like. When the operation support device 100 is a tablet computer, the display unit 50 may be the display of the tablet computer. The display unit 50 of the present example includes three display regions 52 (a display region 52-1, a display region 52-2, and a display region 52-3). In the present example, the instrument information 12 is displayed in the display region 52-1. In FIG. 5, the display region 52-1 is further divided into three regions indicated by data 1 to data 3. In the present example, either of information of the instrument 11-1 (pressure gauge), information of the instrument 11-2 (flow instrument), or information of the instrument 11-3 (liquid level gauge) is displayed in the data 1 to the data 3.

In the display region 52-2 of the present example, the state of the electrolytic apparatus 200 is schematically displayed. In the present example, in the display region 52-2, the introduction tube 92, the introduction tube 93, the discharge tube 94, the discharge tube 95, the switching portion 66, and the electrolyzer 90 in the electrolytic apparatus 200 shown in FIG. 1 are schematically shown.

In the display region 52-3 of the present example, process information in the operation of the electrolytic apparatus 200 is displayed. The process information may include at least any one of a current process of the electrolytic apparatus 200, a next process of the current process, or a time from the current time to the next process. When the next process is in the state of requiring the work by the operator, the process information may also include information on tools or the like necessary for the work by the operator. In the display region 52-3, a button for causing a procedure manual indicating the procedure of the work by the operator to be displayed on the display region 52-3 may be further displayed.

The control unit 60 controls the display unit 50 to display the electrolytic apparatus state information 31. As described above, the electrolytic apparatus state information 31 is based on at least one of the instrument information 12 or the switching portion information 21. As described above, the instrument information 12 may be measurement data by the instrument 11, and the switching portion information 21 may refer to information indicating whether the switching portion 66 is in the open state or the closed state. As described above, the measurement data by the instrument 11 may include the flow rate of the fluid and the pressure of the gas, and the switching portion 66 controls at least one of the flow rate of the fluid or the pressure of the gas. Thus, the electrolytic apparatus state information 31 based on at least one of the instrument information 12 or the switching portion information 21 is displayed on the display unit 50, so that the operator can easily and accurately recognize the work on the electrolytic apparatus 200.

The control unit 60 may control the display unit 50 to display an indication corresponding to the determination result 41 acquired by the determination result acquisition unit 40. The indication corresponding to the determination result 41 refers to, for example, an indication that prompts a work by the operator when the electrolytic apparatus 200 is in the first state S1. The indication corresponding to the determination result 41 refers to an indication indicating a case where the electrolytic apparatus 200 is in the second state S2, for example, a case where the pressure measured by the instrument 11-1 is less than the predetermined pressure, the flow rate measured by the instrument 11-2 is less than the predetermined flow rate, and the liquid level measured by the instrument 11-3 is less than the predetermined liquid level height, so that the switching portion 66 is operating normally.

The display unit 50 may separately display the manual manipulation target switching portion 660 and one or more automatic control target switching portions 670. FIG. 5 is an example of a display manner of the display unit 50 in a case where the determination result acquisition unit 40 acquires the determination result 41 that it is determined that the electrolytic apparatus 200 is currently in the second state S2 (normal state) and in a case where predetermined work by the operator is required in the next process.

In the present example, the target of the predetermined work by the operator is the switching portion 66. In FIG. 5, two switching portions 66 which are the targets of the work in the next process are shown as the manual manipulation target switching portions 660. In the present example, the manual manipulation target switching portion 660 is surrounded by a broken line frame, and the automatic control target switching portion 670 is surrounded by a solid line frame, so that the manual manipulation target switching portion 660 and the automatic control target switching portion 670 are displayed separately. As a result, the operator is less likely to erroneously work on the automatic control target switching portion 670.

In the present example, buttons for causing a next process in the operation of the electrolytic apparatus 200, a time from a current process to the next process, tools or the like necessary for the work by the operator in the next process, and a procedure manual indicating the procedure of the work by the operator to be displayed are displayed in the display region 52-3. In the present example, the operator can cause the procedure manual to be displayed on the display unit 50 by pressing the button. As a result, the operator is less likely to mistake the procedure of the work.

Figure 6:
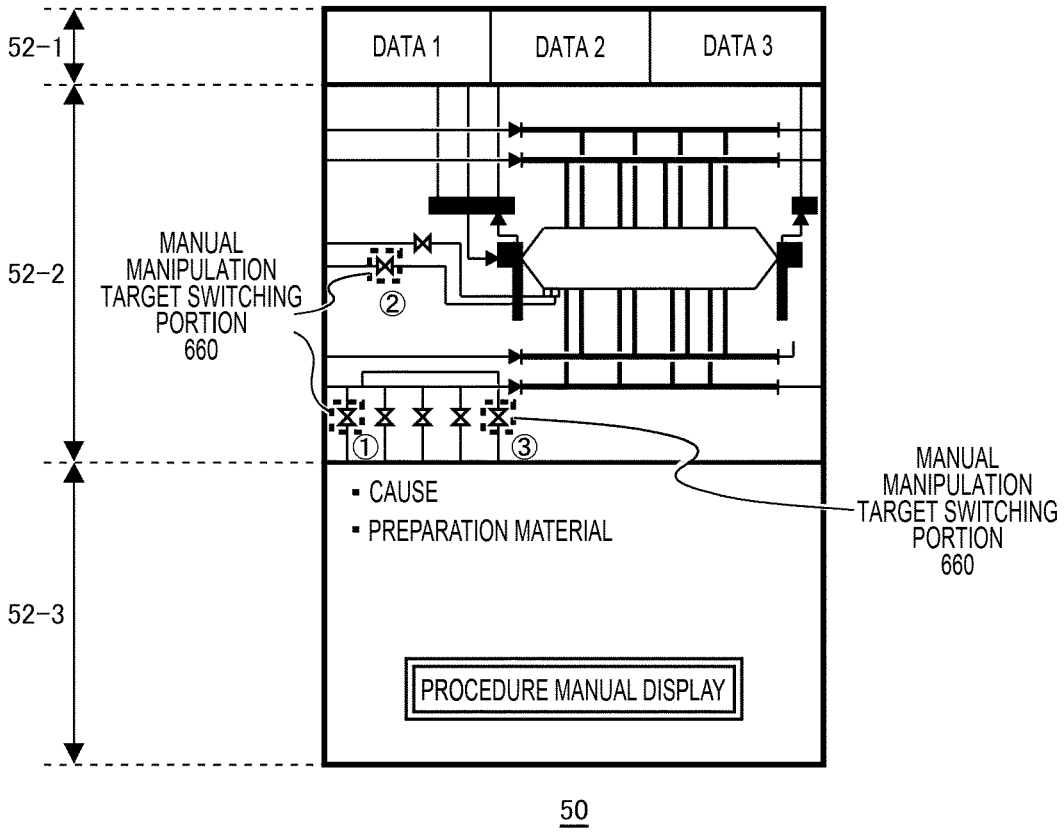
FIG. 6 shows another example of a display manner on the display unit 50.

FIG. 6 shows another example of the display manner on the display unit 50. FIG. 6 is an example of the display manner of the display unit 50 when the determination result acquisition unit 40 acquires the determination result 41 that it is determined that the electrolytic apparatus 200 is currently in the abnormal state (included in the first state S1). In the present example, the target of the work by the operator is the switching portion 66. In FIG. 6, three switching portions 66 which are the targets of the work by the operator are shown as the manual manipulation target switching portions 660.

The display unit 50 may display the manipulation order of the manual manipulation target switching portion 660. In the example shown in FIG. 6, the manipulation order of the three manual manipulation target switching portions 660 is indicated by circled numbers 1 to 3. Since the manipulation order of the manual manipulation target switching portion 660 is displayed on the display unit 50, the operator can easily manipulate the manual manipulation target switching portion 660. The operator is less likely to mistake the manipulation order of the manual manipulation target switching portion 660.

The display unit 50 may sequentially display the manual manipulation target switching portion 660, which is the current manipulation target, on the basis of the manipulation order of the manual manipulation target switching portion 660. In the example shown in FIG. 6, the control unit 60 (see FIG. 4) may control the display unit 50 to sequentially display the manual manipulation target switching portion 660 which is the current manipulation target, for example, by causing the broken line frame surrounding the manual manipulation target switching portion 660 which is the current manipulation target among the three manual manipulation target switching portions 660 indicated by the broken line frames to blink. As a result, the operator is less likely to erroneously manipulate the manual manipulation target switching portion 660 which is not the current manipulation target.

After the operator ends the manipulation on the current manipulation target, the control unit 60 may control the display unit 50 to display another manual manipulation target switching portion 660, for example, by causing a broken line frame surrounding the another manual manipulation target switching portion 660 to blink. When the control unit 60 causes the broken line frame surrounding the manual manipulation target switching portion 660 to blink or the like, the display of the circled numbers 1 to 3 shown in FIG. 6 may not be displayed.

When the determination result acquisition unit 40 acquires the determination result 41 that it is determined that the state of the electrolytic apparatus 200 is the first state S1 (the state of requiring the work by the operator), the display unit 50 may further display a procedure for changing the state from the first state S1 to the second state S2. In the present example, the state of the electrolytic apparatus 200 is the abnormal state. Thus, in the present example, when the determination result acquisition unit 40 acquires the determination result 41 that it is determined that the state of the electrolytic apparatus 200 is the abnormal state, the display unit 50 further displays a procedure for changing the state from the first state S1 to the second state S2.

When the determination result acquisition unit 40 (see FIG. 4) acquires the determination result 41 that it is determined that the state of the electrolytic apparatus 200 is the first state S1, the display unit 50 may further display a procedure for changing the state from the first state S1 to the second state S2 by the control unit 60 automatically controlling the electrolytic apparatus 200. As a result, it becomes easier for the operator to quickly change the state of the electrolytic apparatus 200 from the first state S1 to the second state S2. As a result, it becomes easier to suppress a decrease in the production efficiency of the product P produced by the electrolytic apparatus 200. Herein, the production efficiency refers to a production amount per unit time of the product P.

Also in the present example, similarly to the example shown in FIG. 5, a button for causing the procedure manual indicating the procedure of the work by the operator to be displayed may be displayed in the display region 52-3. In the present example, the operator can cause a procedure manual indicating a procedure for changing the state from the first state S1 to the second state S2 to be displayed on the display unit 50 by pressing the button. The procedure may be manually performed by the operator, or may be automatically performed by the automatic control of the control unit 60.

Figure 7:
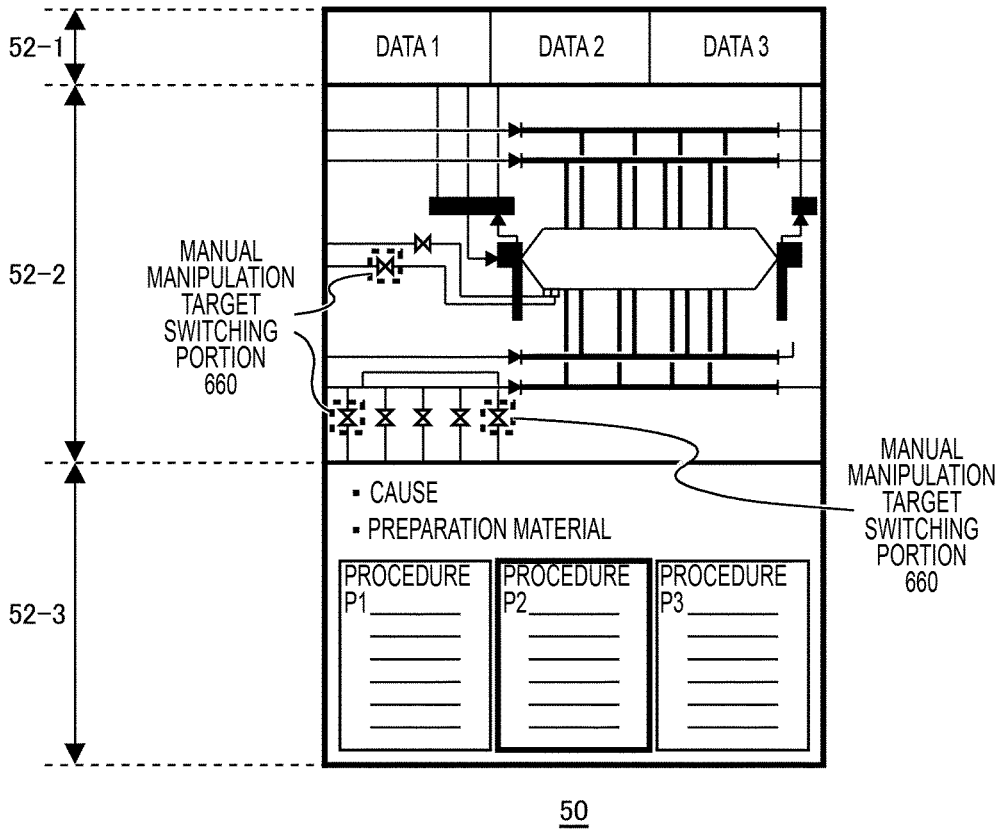
FIG. 7 shows still another example of the display manner on the display unit 50.

FIG. 7 shows another example of the display manner on the display unit 50. FIG. 7 is an example of the display manner after the button for causing the procedure manual indicating the procedure of the work by the operator to be displayed is pressed in FIG. 6. The procedure of the work by the operator is defined as a procedure P. The procedure P for changing the state of the electrolytic apparatus 200 from the first state S1 to the second state S2 may be a procedure P selected from one or more types of procedures P of the process of the operator. When there are a plurality of procedures P for changing the state of the electrolytic apparatus 200 from the first state S1 to the second state S2, the display unit 50 may display the plurality of procedures P. The operator may select one procedure P from the plurality of procedures P on the display unit 50. In FIG. 7, three procedures P (procedures P1 to P3) are shown.

The procedure P selected by the operator may be displayed separately from other procedures P. In the present example, the procedure P selected by the operator is a procedure P2. In FIG. 7, a frame for displaying the procedure P2 is indicated by a thicker line than those of the frames for displaying the other procedures P, whereby the procedure P selected by the operator and the other procedures P are displayed separately.

When the state of the electrolytic apparatus 200 is the abnormal state (included in the first state S1), the display unit 50 may display the procedure P for changing the state of the electrolytic apparatus 200 to the second state S2 by eliminating the abnormal state. When the state of the electrolytic apparatus 200 is the first state S1 and is not the abnormal state, the display unit 50 may display a procedure P of predetermined work by the operator, the procedure being the procedure P for changing the state of the electrolytic apparatus 200 from the first state S1 to the second state S2. As a result, it becomes easier for the operator to quickly change the state of the electrolytic apparatus 200 from the first state S1 to the second state S2. As a result, it becomes easier to suppress a decrease in the production efficiency of the product P produced by the electrolytic apparatus 200.

Figure 8:
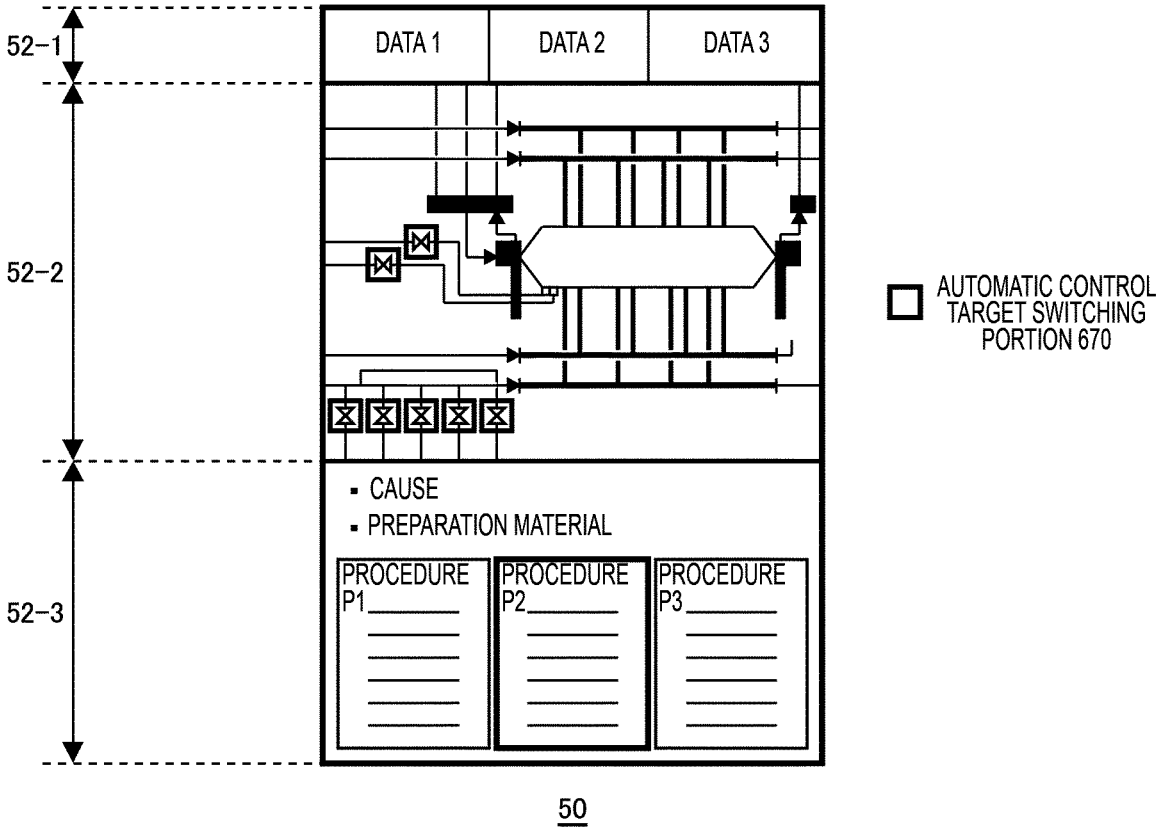
FIG. 8 shows still another example of the display manner on the display unit 50.

FIG. 8 shows another example of the display manner on the display unit 50. FIG. 8 is an example of the display manner after the state of the electrolytic apparatus 200 is changed from the first state S1 to the second state S2 by the procedure P (procedure P2) selected in FIG. 7. The determination result acquisition unit 40 (see FIG. 4) may acquire the determination result 41 obtained by further determining whether the state of the electrolytic apparatus 200 has changed from the first state S1 to the second state S2 according to the procedure P.

When the determination result acquisition unit 40 acquires the determination result 41 that it is determined that the state of the electrolytic apparatus 200 has changed from the first state S1 to the second state S2, the control unit 60 (see FIG. 4) may control the display unit 50 to display all the switching portions 66 as the automatic control target switching portion 670. In FIG. 8, all the switching portions 66 are surrounded by solid line frames. As a result, the operator can easily confirm that the state of the electrolytic apparatus 200 has become the second state S2.

Figure 9:
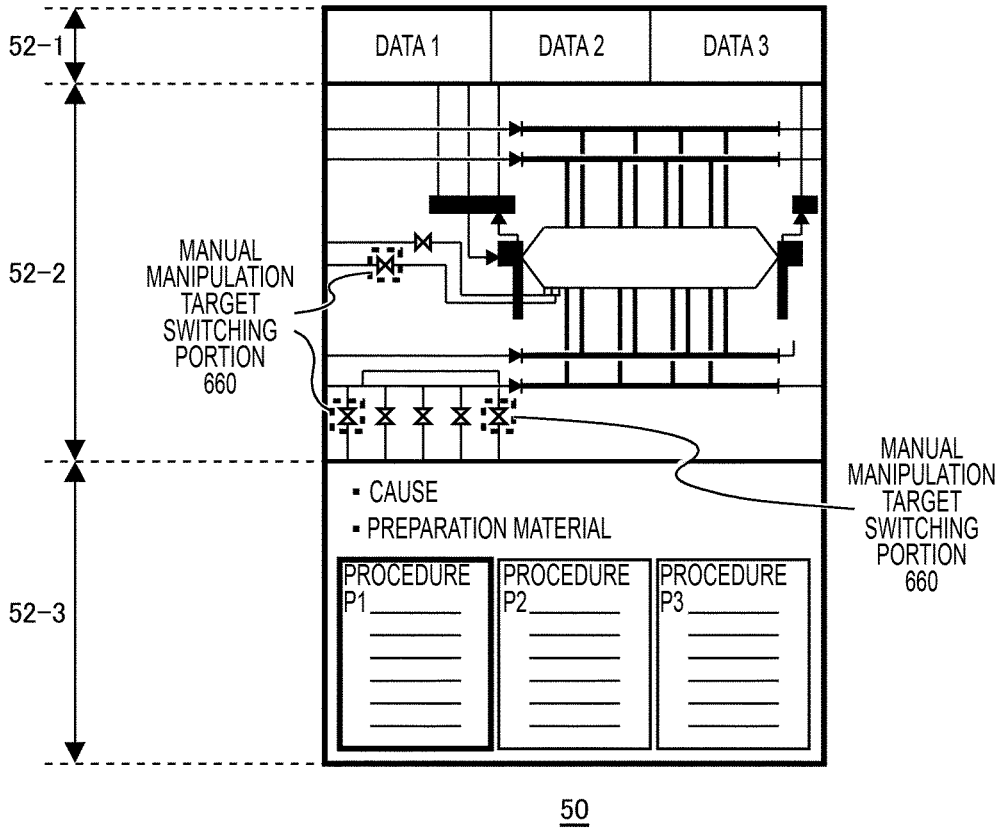
FIG. 9 shows still another example of the display manner on the display unit 50.

FIG. 9 shows another example of the display manner on the display unit 50. FIG. 9 is an example of the display manner after the state of the electrolytic apparatus 200 is not changed from the first state S1 to the second state S2 by the procedure P (procedure P2) selected in FIG. 7 within a time less than a predetermined allowable time Tth.

The elapsed time acquisition unit 112 (see FIG. 4) may acquire an elapsed time T for which the first state S1 continues after acquiring the determination result 41 that the state of the electrolytic apparatus 200 is the first state S1. In the example of FIG. 9, the elapsed time acquisition unit 112 may acquire the elapsed time T while the operator is performing the work for changing the state of the electrolytic apparatus 200 from the first state S1 to the second state S2 by the procedure P2. In the present example, the procedure P2 is defined as an initial procedure P2.

When the determination result acquisition unit 40 acquires the determination result 41 that the elapsed time T is longer than the predetermined allowable time Tth, the display unit 50 may further display another procedure P different from the initial procedure P2. In the example of FIG. 9, the display unit 50 displays the procedure P1 different from the initial procedure P2.

The procedure P1 may include another procedure from which the order of the work on the plurality of manual manipulation target switching portions 660, the order of work on the manual manipulation target switching portion 660 and the electrolyzer 90, and the like in the initial procedure P2 are different. When the initial procedure P2 is the procedure of the manual work by the operator, the procedure P1 may be the procedure of the automatic control by the control unit 60. When the procedure P1 is the procedure P of the automatic control by the control unit 60, the display unit 50 may display the procedure P1 in the display region 52-3.

The predetermined allowable time Tth may be a time for which the safety of the electrolytic apparatus 200 can be secured even when the first state S1 is continued. For example, when the first state S1 is the abnormal state, the liquid 70, the liquid 72, the liquid 75, and the liquid 75 (see FIG. 1) are likely to retain in the electrolyzer 90. When the liquid 70, the liquid 72, the liquid 75, and the liquid 75 (see FIG. 1) are retained in the electrolyzer 90, each member in the electrolyzer 90 may be deteriorated by the liquid 70, the liquid 72, the liquid 75, and the liquid 75. The predetermined allowable time Tth may be, for example, a time within a range in which the deterioration does not occur.

Figure 10:
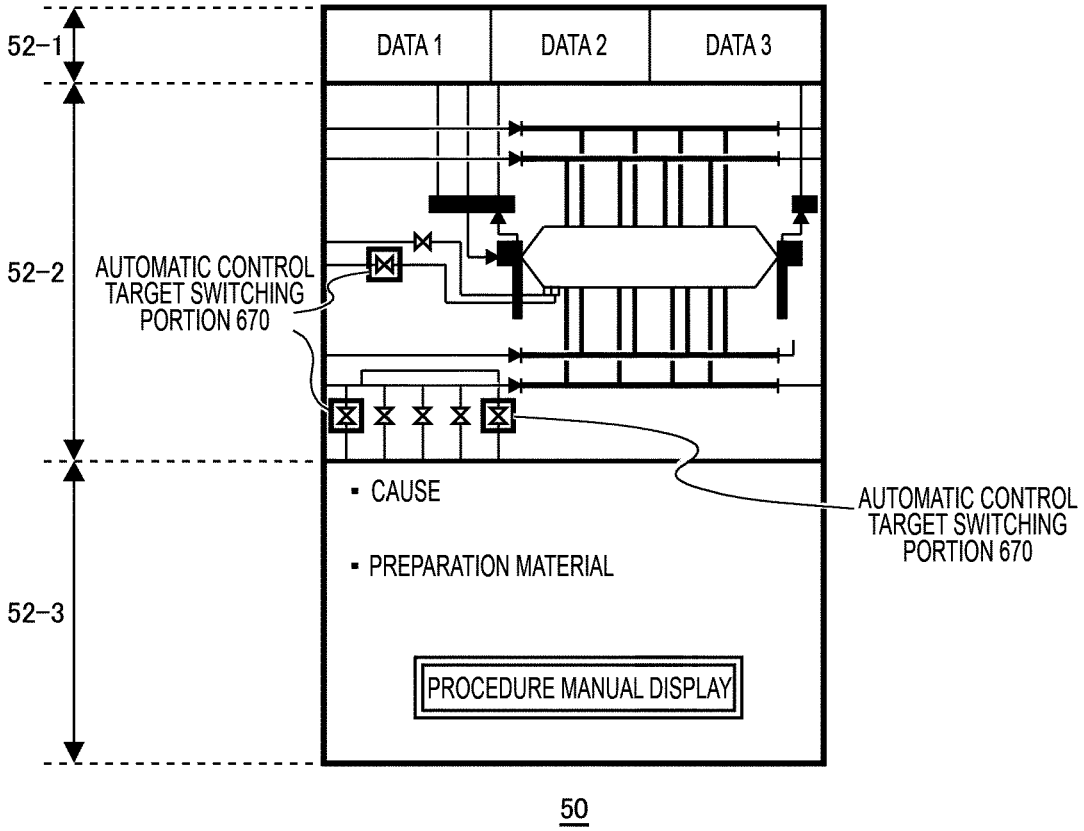
FIG. 10 shows still another example of the display manner on the display unit 50.

FIG. 10 shows another example of the display manner on the display unit 50. FIG. 10 shows an example of the display manner of the display unit 50 when the determination result acquisition unit 40 acquires the determination result 41 that it is determined that the electrolytic apparatus 200 is currently in the abnormal state (included in the first state S1).

When the determination result acquisition unit 40 acquires the determination result 41 that it is determined that the electrolytic apparatus 200 is currently in the abnormal state, the control unit 60 may set at least one of the switching portions 66 to be in a fixed state, to be unmanipulable, or to be unopenable. In the present specification, setting the switching portion 66 to be in the fixed state, to be unmanipulable, or to be unopenable is defined as locking the switching portion 66.

The control unit 60 may lock at least one of the automatic control target switching portions 670. In the present example, three automatic control target switching portions 670 are locked. In FIG. 10, the locked automatic control target switching portions 670 are surrounded by solid line frames. By the control unit 60 locking the automatic control target switching portion 670, the operation support device 100 (see FIG. 4) can easily prevent the operator from erroneously setting the automatic control target switching portion 670 as a work target when the electrolytic apparatus 200 is in the abnormal state.

The control unit 60 may lock at least one of the manual manipulation target switching portions 660. When the determination result acquisition unit 40 acquires the determination result 41 that it is determined that the electrolytic apparatus 200 is currently in the abnormal state, the control unit 60 may lock the manual manipulation target switching portion 660, which is not the current manipulation target, among the manual manipulation target switching portions 660 which are targets of the work by the operator. As a result, even when the operator erroneously tries to work on the manual manipulation target switching portion 660 which is not the current manipulation target, the manual manipulation target switching portion 660 is not operated. As a result, a decrease in the production efficiency of the product P due to the erroneous work on the manual manipulation target switching portion 660 is easily suppressed.

When the control unit 60 locks at least one of the switching portions 66, the display unit 50 may display the switching portion 66 separately from the other switching portions 66. The other switching portions 66 refer to the switching portions 66 which are not locked. That is, the other switching portions 66 refer to the switching portions 66 operating normally. In the present example, the locked switching portion 66 (automatic control target switching portion 670) is surrounded by a solid line frame, and the unlocked switching portion 66 is not surrounded by a solid line frame, whereby the locked switching portion 66 and the unlocked switching portion 66 are displayed separately. As a result, the operator can easily recognize the switching portion 66 that can be manually manipulated.

The selection unit 110 (see FIG. 4) may select the procedure P corresponding to the type of the first state S1 (the state of requiring the work by the operator). The type of the first state S1 refers to a type of a target of the process of the operator. The target may include a manipulation of the manual manipulation target switching portion 660, work of detaching a nozzle arranged at an outlet on the cathode 82 side of the ion exchange membrane 84 of the electrolysis cell 91, application of soap water to the nozzle, confirmation of swelling of foam of the soap water, and the like.

The selection unit 110 may select the procedure P corresponding to the current first state S1 of the electrolytic apparatus 200 among a plurality of types of the first state S1. One of the plurality of types is defined as a first type, and another is defined as a second type. The first type may be, for example, recovery from the abnormal state to the second state S2 (normal state) when the electrolytic apparatus 200 is in the abnormal state. The second type may be, for example, a predetermined confirmation or the like for the switching portion 66 or the like when the electrolytic apparatus 200 is in the first state S1 but is not in the abnormal state.

The determination result acquisition unit 40 (see FIG. 4) may further acquire a result obtained by determining whether the state of the electrolytic apparatus 200 has changed from the first state S1 to the second state S2 according to the procedure selected by the selection unit 110. In a case where the operator is performing the work for changing the state of the electrolytic apparatus 200 from the first state S1 to the second state S2 according to the procedure selected by the selection unit 110, when the determination result acquisition unit 40 acquires the determination result 41 indicating that the elapsed time T is longer than the predetermined allowable time Tth, the display unit 50 may further display another procedure P different from the procedure P selected until the elapsed time T exceeds the allowable time Tth. As a result, the operator can easily work on the electrolytic apparatus 200 on the basis of the another procedure P.

The storage unit 114 may store the type of the first state S1, the procedure P corresponding to the type of the first state S1, and another procedure P different from the procedure P. When the determination result acquisition unit 40 (see FIG. 4) acquires the determination result 41 that it is determined that the state of the electrolytic apparatus 200 is the first state S1, the display unit 50 may display the type of the first state S1, the procedure P corresponding to the type of the first state S1, and another procedure P different from the procedure P stored in the storage unit 114.

The determination result acquisition unit 40 (see FIG. 4) may acquire a result obtained by determining whether the state of the electrolytic apparatus 200 is the first state S1 or the second state S2 on the basis of a predetermined standard. The predetermined standard is defined as the standard Std.

The standard Std may be the predetermined pressure Pr of at least one of the gas 77 or the gas 78 (see FIG. 2). The standard Std may be the predetermined pressure difference Dpr between the gas 77 and the gas 78. The standard Std may be a predetermined flow rate Fm per unit time of at least one of the liquid 70, the liquid 72, the liquid 74, or the liquid 76 (see FIG. 1), or an integrated flow rate Afm over a predetermined time of the flow rate Fm. The standard Std may be a predetermined height h of at least one of the liquid 73 or the liquid 75 (see FIG. 2). For example, when the pressure of at least one of the gas 77 or the gas 78 is equal to or higher than the pressure Pr, the determination result acquisition unit 40 may acquire the result that it is determined that the state of the electrolytic apparatus 200 is the first state S1.

The standard Std may be a predetermined time change rate Prt of the pressure of at least one of the gas 77 or the gas 78. A predetermined time change rate Dprt of the pressure difference between the gas 77 and the gas 78 may be used. The standard Std may be a predetermined time change rate Fmt of the flow rate in at least one of the liquid 70, the liquid 72, the liquid 74, or the liquid 76. The standard Std may be a predetermined time change rate ht of the height of at least one of the liquid 73 or the liquid 75. For example, when the time change rate of the pressure of at least one of the gas 77 or the gas 78 is equal to or larger than the time change rate Prt, the determination result acquisition unit 40 may acquire the result that it is determined that the state of the electrolytic apparatus 200 is the first state S1.

The storage unit 114 (see FIG. 4) may further store the procedure P selected by the selection unit 110 (see FIG. 4) and the elapsed time T acquired by the elapsed time acquisition unit 112 (see FIG. 4). The update unit 116 (see FIG. 4) may update the standard Std on the basis of the procedure P and the elapsed time T stored in the storage unit 114. The determination result acquisition unit 40 (see FIG. 4) may acquire a result obtained by determining whether the state of the electrolytic apparatus 200 is first state S1 or the second state S2 on the basis of the updated standard Std.

Since the updated standard Std is based on the procedure P and the elapsed time T stored in the storage unit 114, the updated standard Std reflects the history of the determination results 41 of the first state S1 and the second state S2 by the determination result acquisition unit 40. For example, when there is a history that the electrolytic apparatus 200 has been in the abnormal state, the updated standard Std reflects the content of the abnormality. The content of the abnormality is, for example, that the pressure of at least one of the gas 77 or the gas 78 is equal to or higher than the pressure Pr. Thus, when the determination result acquisition unit 40 acquires the result obtained by determining the state of the electrolytic apparatus 200 on the basis of the updated standard Std, the determination result acquisition unit 40 can easily acquire the result obtained by determining whether the state of the electrolytic apparatus 200 is the first state S1 or the second state S2 on the basis of the more appropriate standard Std compared to the case of acquiring the result obtained by determining the state of the electrolytic apparatus 200 on the basis of the standard Std which is not updated.

The control unit 60 (see FIG. 4) may accept the end of the work by the operator. When the operator ends the work for changing the state of the electrolytic apparatus 200 from the first state S1 to the second state S2, the operator may input, to the operation support device 100, information indicating that the work is ended (see FIG. 4). The control unit 60 may accept the input.

In a case where the determination result acquisition unit 40 (see FIG. 4) acquires the determination result 41 that it is determined that the state of the electrolytic apparatus 200 is the first state S1, when the control unit 60 accepts the end of the work by the operator, the determination result acquisition unit 40 may further acquire the result obtained by determining whether the state of the electrolytic apparatus 200 is transitionable from the first state S1 to the second state S2 by the work by the operator. Even when the control unit 60 accepts the end of the work by the operator, there is a case where the electrolytic apparatus 200 is not transitionable from the first state S1 to the second state S2 due to the work mistake of the operator or the like. Thus, the determination result acquisition unit 40 may further acquire the result obtained by determining whether the electrolytic apparatus 200 is in the state of being transitionable from the first state S1 to the second state S2 by the work by the operator. Note that the operator may be a human or may be a robot controlled by artificial intelligence (AI).

Figure 11:
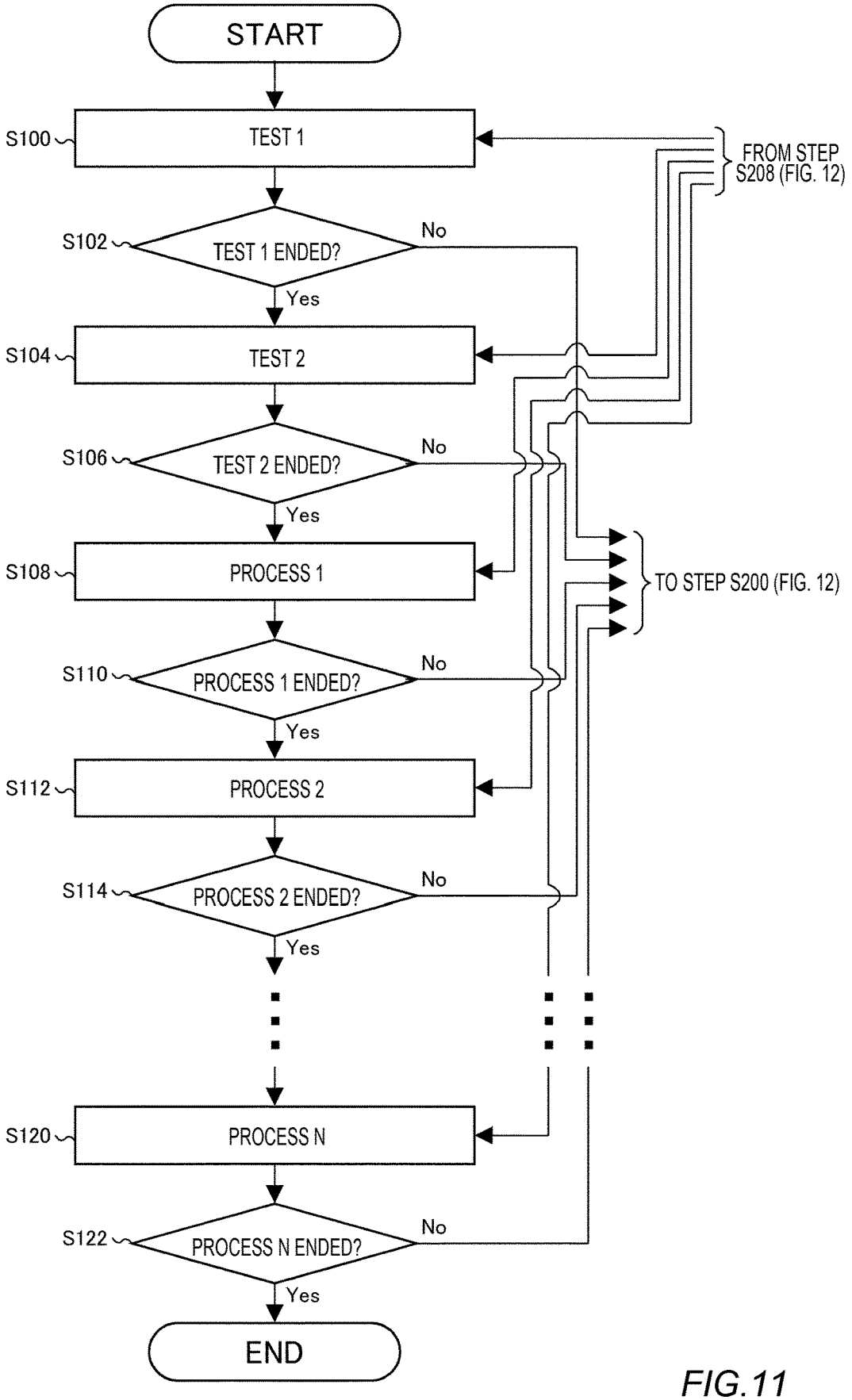
FIG. 11 is a first flowchart including an example of an operation support method according to one embodiment of the present invention.

FIG. 11 is a first flowchart including an example of an operation support method according to one embodiment of the present invention. The operation support method according to one embodiment of the present invention is an operation support method for supporting the operation of the electrolytic apparatus 200 (see FIG. 1). FIG. 11 is an example of the operation support method when the operation support device 100 is used.

Step S100 is a stage where the electrolytic apparatus 200 performs Test 1. Test 1 in the present example is a preparation stage for generating Cl (chlorine) and NaOH (sodium hydroxide) by the electrolytic apparatus 200 electrolyzing an aqueous solution of NaCl (sodium chloride).

Step S102 is a stage of determining whether step S100 has ended. When it is determined that step S100 has ended, the operation support method proceeds to step S104. When it is determined that step S100 does not end, the operation support method proceeds to step S200 (described below).

Step S104 is a stage where the electrolytic apparatus 200 performs Test 2. Test 2 is a preparation stage for generating Cl (chlorine) and NaOH (sodium hydroxide) by the electrolytic apparatus 200 electrolyzing an aqueous solution of NaCl (sodium chloride), and may be a stage for performing a test different from Test 1.

Step S106 is a stage of determining whether step S104 has ended. When it is determined that step S104 has ended, the operation support method proceeds to step S106. When it is determined that step S104 does not end, the operation support method proceeds to step S200 (described below).

Step S108 is a stage where the electrolytic apparatus 200 performs process 1. Process 1 in the present example is a first stage for generating Cl (chlorine) and NaOH (sodium hydroxide) by the electrolytic apparatus 200 electrolyzing an aqueous solution of NaCl (sodium chloride).

Step S110 is a stage of determining whether step S108 has ended. When it is determined that step S108 has ended, the operation support method proceeds to step S112. When it is determined that step S108 does not end, the operation support method proceeds to step S200 (described below).

Step S112 is a stage where the electrolytic apparatus 200 performs process 2. Process 2 in the present example is a second stage for generating Cl (chlorine) and NaOH (sodium hydroxide) by the electrolytic apparatus 200 electrolyzing an aqueous solution of NaCl (sodium chloride).

Step S114 is a stage of determining whether step S112 has ended. When it is determined that step S112 has ended, the operation support method proceeds to the next step. When it is determined that step S112 does not end, the operation support method proceeds to step S200 (described below).

Step S120 is a stage where the electrolytic apparatus 200 performs process N. Herein, N is an integer of 3 or more. Process N in the present example is an N-th stage for generating Cl (chlorine) and NaOH (sodium hydroxide) by the electrolytic apparatus 200 electrolyzing an aqueous solution of NaCl (sodium chloride). In the operation support method of the present example, the electrolytic apparatus 200 performs processes 1 to N.

Step S120 is a stage of determining whether step S122 has ended. When it is determined that step S120 has ended, the operation support method ends the entire processing. When it is determined that step S120 does not end, the operation support method proceeds to step S200 (described below).

Figure 12:
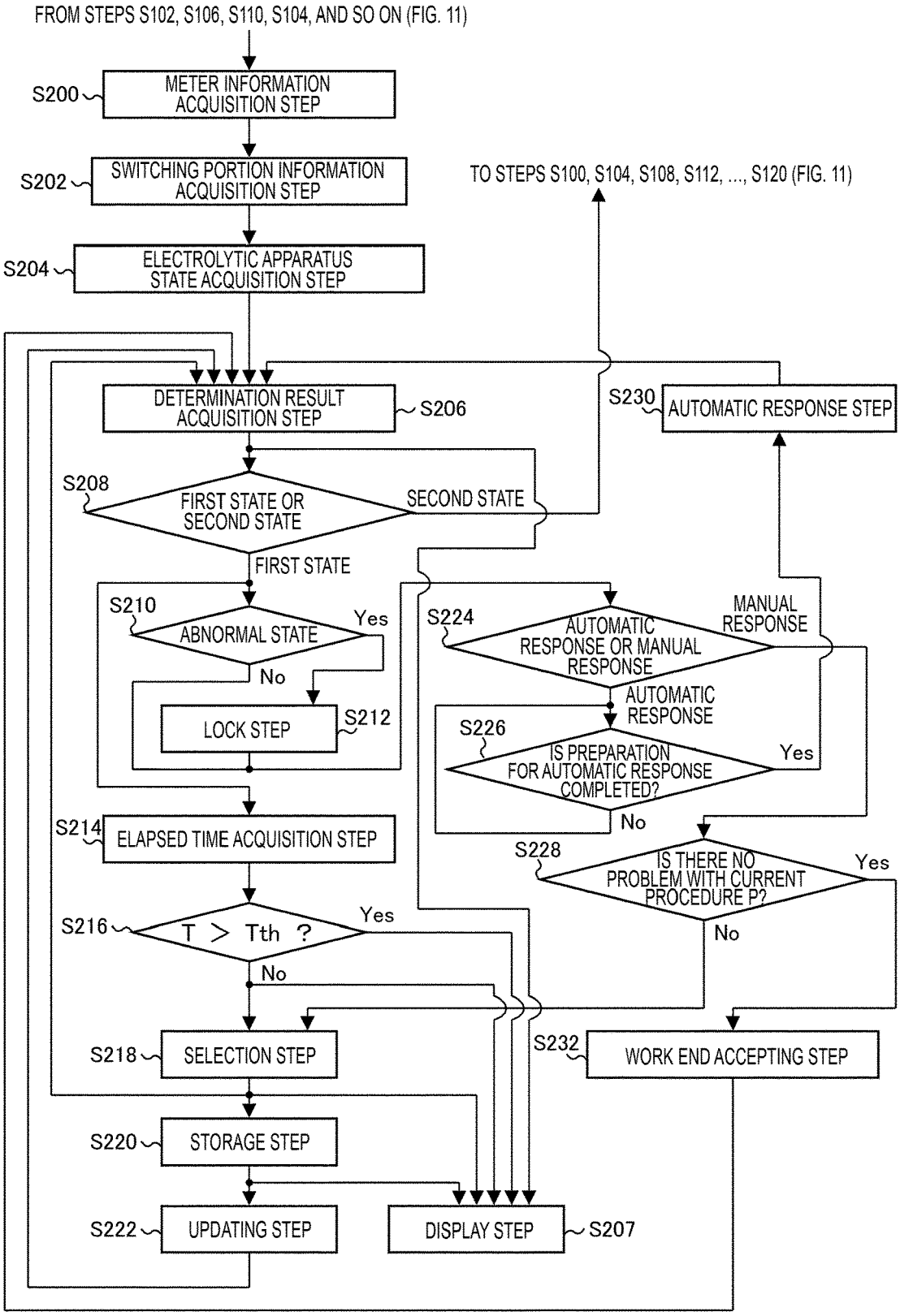
FIG. 12 is a second flowchart including an example of the operation support method according to one embodiment of the present invention.

FIG. 12 is a second flowchart including an example of the operation support method according to one embodiment of the present invention. FIG. 12 is an example of the operation support method when the operation support device 100 is used.

An instrument information acquisition step S200 is a step in which the instrument information acquisition unit 10 (see FIG. 4) acquires the instrument information 12 (see FIG. 4). The instrument information 12 is measurement data measured by the instrument 11 (see FIGS. 1 and 2), and includes the measurement data obtained by measuring parameters regarding the electrolytic apparatus 200. Step S200 is performed when it is determined that each process of step S100, step S104, step S108, step S112, and step S120 does not end.

A switching portion information acquisition step S202 is a step of acquiring the switching portion information 21 indicating information regarding switching portion 66 (see FIGS. 1 and 2). The electrolytic apparatus 200 (FIG. 1) has one or more switching portions 66. The switching portion 66 controls at least one of the flow rate of a fluid or the pressure of gas. The fluid may be at least any one of the liquid 70 (see FIG. 1), the liquid 72 (see FIG. 1), the liquid 74 (see FIG. 1), or the liquid 76 (see FIG. 1). The gas may be at least one of the gas 77 (see FIG. 2) or the gas 78 (see FIG. 2).

An electrolytic apparatus state acquisition step S204 is a step in which the electrolytic apparatus state acquisition unit 30 acquires the electrolytic apparatus state information 31 (see FIG. 4). The electrolytic apparatus state acquisition unit 30 acquires the electrolytic apparatus state information 31 indicating the state of the electrolytic apparatus 200 on the basis of at least one of the instrument information 12 or the switching portion information 21.

A determination result acquisition step S206 is a step in which the control unit 60 acquires the determination result 41 that it is determined that the state of the electrolytic apparatus 200 is the first state S1 or the determination result 41 that it is determined that the state of the electrolytic apparatus 200 is the first state S1. The determination result 41 is a result that the determination result acquisition unit 40 (see FIG. 4) determines that the state of the electrolytic apparatus 200 is the first state S1 when the electrolytic apparatus state information 31 is in the predetermined first condition C1. The determination result 41 is a result that the determination result acquisition unit 40 (see FIG. 4) determines that the state of the electrolytic apparatus 200 is the second state S2 when the electrolytic apparatus state information 31 is in the second condition C2 different from the first condition C1.

As described above, the first condition C1 may be the state of the electrolytic apparatus 200 in which predetermined work by the operator is assumed. For example, the first condition C1 may be the manual confirmation or the like for the electrolyzer 90 by the operator when the pressure of at least one of the gas 77 or the gas 78 is equal to or higher than the predetermined pressure Pr.

As described above, the second condition C2 may be a condition that satisfies the standard Std. For example, as described below, in a case where the standard Std is the predetermined pressure Pr of at least one of the gas 77 or the gas 78, when the pressure of at least one of the gas 77 or the gas 78 is less than the pressure Pr, the electrolytic apparatus state information 31 satisfies the second condition C2 (satisfies the standard Std).

As described above, when the state of the electrolytic apparatus 200 is the first state S1, the control unit 60 (see FIG. 4) does not control the switching portion 66, but controls the display unit 50 to perform display to prompt a work by the operator. The work by the operator may include at least any one of the manipulation of the manual manipulation target switching portion 660 (see FIG. 1) in which the operator manually manipulates switching portion 66, the confirmation for electrolytic apparatus 200, and the confirmation for the components of the electrolytic apparatus 200. When the state of electrolytic apparatus 200 is the second state S2, the control unit 60 automatically controls the switching portion 66.

A display step S207 is a step in which the control unit 60 (see FIG. 4) controls the display unit 50 to display the electrolytic apparatus state information 31. The display step S207 may be a step in which the control unit 60 controls the display unit 50 to display an indication corresponding to the determination result 41 acquired by the determination result acquisition unit 40. The indication corresponding to the determination result 41 refers to, for example, an indication that prompts a work by the operator work when the electrolytic apparatus 200 is in the first state S1. The indication corresponding to the determination result 41 refers to an indication indicating a case where the electrolytic apparatus 200 is in the second state S2, for example, a case where the pressure measured by the instrument 11-1 is less than the predetermined pressure, the flow rate measured by the instrument 11-2 is less than the predetermined flow rate, and the liquid level measured by the instrument 11-3 is less than the predetermined liquid level height, so that the switching portion 66 is operating normally.

In the display step S207, the display unit 50 (see FIG. 4) may separately display the manual manipulation target switching portion 660 (see FIG. 1) and one or more automatic control target switching portions 670 (see FIG. 1). The manual manipulation target switching portion 660 is a switching portion 66 manually manipulated by the operator. The automatic control target switching portion 670 is a target of the automatic control of the electrolytic apparatus 200. As a result, the operator is less likely to erroneously work on the automatic control target switching portion 670.

When the determination result acquisition unit 40 (see FIG. 4) acquires the determination result 41 that it is determined that the state of the electrolytic apparatus 200 is the first state S1 in the determination result acquisition step S206, in the display step S207, the display unit 50 may further display the procedure P for changing the state from the first state S1 to the second state S2. The procedure P may be selected from one or more types of procedures of the process of the operator. As a result, it becomes easier for the operator to quickly change the state of the electrolytic apparatus 200 from the first state S1 to the second state S2. As a result, it becomes easier to suppress a decrease in the production efficiency of the product P produced by the electrolytic apparatus 200.

In the display step S207, the display unit 50 may display a plurality of procedures P for changing the state of the electrolytic apparatus 200 from the first state S1 to the second state S2. In the display step S207, when the state of the electrolytic apparatus 200 is the abnormal state (included in the first state S1), the display unit 50 may display the procedure P for changing the state of the electrolytic apparatus 200 to the second state S2 by eliminating the abnormal state. In the display step S207, when the state of the electrolytic apparatus 200 is the first state S1 and is not the abnormal state, the display unit 50 may display the procedure P for changing the state of the electrolytic apparatus 200 from the first state S1 to the second state S2. The procedure P may be the procedure P of the predetermined work by the operator.

A determination step S208 is a step of determining whether the determination result 41 acquired in the determination result acquisition step S206 is the result that it is determined that the state of the electrolytic apparatus 200 is the first state S1 (the state of requiring the work by the operator) or the result that it is determined that the state is the second state S2 (the state of not requiring the work by the operator). In the determination step S208, the control unit 60 (see FIG. 4) may determine whether the determination result 41 is the result that it is determined that the state is the first state S1 or the result that it is determined that the state is the second state S2.

When, in the determination step S208, the determination result 41 is the result that it is determined that the state of the electrolytic apparatus 200 is the first state S1, the operation support method proceeds to the determination step S210. When, in the determination step S208, the determination result 41 is the result that it is determined that the state of the electrolytic apparatus 200 is the second state S2, the operation support method returns to either of steps S100, S104, S108, S112, or S120 (see FIG. 11).

A determination step S210 is a stage in which the determination result acquisition unit 40 determines whether the first state S1 is the abnormal state when, in the determination step S208, the determination result 41 is the result that it is determined that the state of the electrolytic apparatus 200 is the first state S1 (the state of requiring the work by the operator). As described above, the first state S1 of the present example includes the abnormal state where the state of the electrolytic apparatus 200 is abnormal.

When the determination result acquisition unit 40 determines that the state of the electrolytic apparatus 200 is the abnormal state, the operation support method proceeds to a lock step S212. When the determination result acquisition unit 40 determines that the state of the electrolytic apparatus 200 is not the abnormal state, the operation support method proceeds to a selection step S218.

The lock step S212 is a step in which the control unit 60 (see FIG. 4) sets at least one of the switching portions 66 to be in the fixed state, to be unmanipulable, or to be unopenable. The control unit 60 may lock at least one of the automatic control target switching portions 670. By the control unit 60 locking the automatic control target switching portion 670, the operation support device 100 (see FIG. 4) can easily prevent the operator from erroneously setting the automatic control target switching portion 670 as a work target when the electrolytic apparatus 200 is in the abnormal state.

The control unit 60 may lock at least one of the manual manipulation target switching portions 660. The control unit 60 may lock the manual manipulation target switching portion 660, which is not the current manipulation target, among the manual manipulation target switching portions 660 which are targets of the work by the operator. As a result, even when the operator erroneously tries to work on the manual manipulation target switching portion 660 which is not the current manipulation target, the manual manipulation target switching portion 660 is not operated. As a result, a decrease in the production efficiency of the product P due to the erroneous work on the manual manipulation target switching portion 660 is easily suppressed.

In the lock step S212, when the control unit 60 (see FIG. 4) locks at least one of the switching portions 66, the display unit 50 may display the switching portion 66 separately from the other switching portions 66. The other switching portions 66 refer to the switching portions 66 which are not locked. That is, the other switching portions 66 refer to the switching portions 66 operating normally.

After the control unit 60 locks at least one of the switching portions 66 in the lock step S212, the operation support method proceeds to a determination step S224. The determination step S224 will be described below.

The determination result acquisition step S206 may be a step in which the determination result acquisition unit 40 (see FIG. 4) acquires the determination result 41 obtained by further determining whether the state of the electrolytic apparatus 200 has changed from the first state S1 to the second state S2 according to the procedure P. When the determination result acquisition step S206 is a step of acquiring the determination result 41, the operation support method may further include an elapsed time acquisition step S214.

The elapsed time acquisition step S214 may be a step in which the elapsed time acquisition unit 112 (see FIG. 4) acquires the elapsed time T for which the electrolytic apparatus 200 continues to be in the first state S1. The elapsed time T may be an elapsed time after the determination result acquisition unit 40 acquires the determination result 41 that the state of the electrolytic apparatus 200 is the first state S1 in the determination result acquisition step S206.

The determination step S216 is a step of determining whether the elapsed time T acquired by the elapsed time acquisition unit 112 in the elapsed time acquisition step S214 is longer than the predetermined allowable time Tth. In the determination step S216, the control unit 60 (see FIG. 4) may determine whether the elapsed time T is longer than the predetermined allowable time Tth.

When it is determined in the determination step S216 that the elapsed time T is longer than the predetermined allowable time Tth, in the display step S207, the display unit 50 may further display another procedure P. The another procedure P is a procedure P for returning the electrolytic apparatus 200 from the first state S1 to the second state S2 and is another procedure P different from the initial procedure P for returning the electrolytic apparatus 200 from the first state S1 to the second state S2. When it is determined in the determination step S216 that the elapsed time T is equal to or less than the predetermined allowable time Tth, in the display step S207, the display unit 50 may further display the procedure P. As a result, the operator can easily work on the electrolytic apparatus 200 on the basis of the another procedure P. When it is determined in the determination step S216 that the elapsed time T is longer than the predetermined allowable time Tth, the operation support method proceeds to the selection step S218.

The operation support method may further include the selection step S218. The selection step S218 is a step in which the selection unit 110 selects the procedure P corresponding to the type of the first state S1. The type of the first state S1 refers to a type of a target of the process of the operator. The target may include a manipulation of the manual manipulation target switching portion 660, work of detaching a nozzle arranged at an outlet on the cathode 82 side of the ion exchange membrane 84 of the electrolysis cell 91, application of soap water to the nozzle, confirmation of swelling of foam of the soap water, and the like.

In the selection step S218, the selection unit 110 may select the procedure P corresponding to the current first state S1 of the electrolytic apparatus 200 among the plurality of types of the first state S1. Assuming that one of the plurality of types is the first type, and another are the second type, for example, the first type may be recovery from the abnormal state to the second state S2 (normal state) when the electrolytic apparatus 200 is in the abnormal state, and the second type may be a predetermined confirmation for the switching portion 66 or the like when the electrolytic apparatus 200 is in the first state S1 but is not in the abnormal state.

When the selection unit 110 selects the procedure P corresponding to the type of the first state S1, the determination result acquisition step S206 may be a step in which the determination result acquisition unit 40 (see FIG. 4) acquires the result obtained by further determining whether the state of the electrolytic apparatus 200 has changed from the first state S1 to the second state S2 according to the procedure P selected in the selection step S218. When the selection unit 110 selects the procedure P corresponding to the type of the first state S1, the determination result acquisition step S206 may be a step in which the determination result acquisition unit 40 acquires the result obtained by further determining whether the state of the electrolytic apparatus 200 has changed from the first state S1 (the state of requiring the work by the operator) to the second state S2 (the state of not requiring the work by the operator) (the state of the automatic control) according to the work of the procedure P by the operator.

In the display step S207, the display unit 50 may further display another procedure P different from the procedure P selected in the selection step S218. In the selection step S218, after the selection unit 110 selects the procedure P corresponding to the current first state S1 of the electrolytic apparatus 200, the operation support method proceeds to a storage step S220.

The operation support method may further include the storage step S220. The storage step S220 is a step in which the storage unit 114 stores the type of the first state S1, the procedure P corresponding to the type of the first state S1, and another procedure P. The storage step S220 may be a step in which the storage unit 114 further stores the procedure P selected in the selection step S218 and the elapsed time T acquired in the elapsed time acquisition step S214.

When the storage unit 114 stores the type of the first state S1, the procedure P corresponding to the type of the first state S1, and another procedure P, in the determination result acquisition step S206, the determination result acquisition unit 40 (see FIG. 4) may acquire the determination result 41 that it is determined that the state of the electrolytic apparatus 200 is the first state S1. When the determination result acquisition unit 40 acquires the determination result 41 that it is determined that the state of the electrolytic apparatus 200 is the first state S1 in the determination result acquisition step S206, in the display step S207, the display unit 50 may display the type of the first state S1, the procedure P corresponding to the type of the first state S1, and the another procedure P which are stored in the storage step S220.

The determination result acquisition step S206 may be a step in which the determination result acquisition unit 40 (see FIG. 4) acquires the result obtained by determining whether the state of the electrolytic apparatus 200 is either of the first state S1 or the second state S2 on the basis of the predetermined standard Std. The standard Std may be that the pressure of at least one of the gas 77 or the gas 78 (see FIG. 2) is less than the predetermined pressure Pr. The standard Std may be that a pressure difference between the gas 77 and the gas 78 is less than the predetermined pressure difference Dpr. The standard Std may be that a flow rate per unit time of at least one of the liquid 70, the liquid 72, the liquid 74, or the liquid 76 (see FIG. 1) is less than the predetermined flow rate Fm. The standard Std may be that the liquid level height of at least one of the liquid 73 or the liquid 75 (see FIG. 2) is less than a predetermined height.

The operation support method may further include an updating step S222. The updating step S222 is a step in which the update unit 116 updates the predetermined standard Std on the basis of the procedure P and the elapsed time T stored in the storage step S220.

Since the updated standard Std is based on the procedure P and the elapsed time T stored in the storage unit 114, the updated standard Std reflects the history of the determination results 41 of the first state S1 and the second state S2 by the determination result acquisition unit 40 in the determination result acquisition step S206. Thus, in the determination result acquisition step S206, the determination result acquisition unit 40 acquires the result obtained by determining the state of the electrolytic apparatus 200 on the basis of the updated standard Std, so that the determination result acquisition unit 40 can easily acquire the result obtained by more accurately determining whether the state of the electrolytic apparatus 200 is the first state S1 or the second state S2 compared to the case of acquiring the result obtained by determining the state of the electrolytic apparatus 200 on the basis of the standard Std which is not updated.

When the determination result acquisition unit 40 (see FIG. 4) acquires the result that it is determined that the state of the electrolytic apparatus 200 is the first state S1 (including the abnormal state) in the determination result acquisition step S206, the operation support method proceeds to the determination step S224. The determination step S224 is a step of determining whether to change the state of electrolytic apparatus 200 from the first state S1 to the second state S2 by the automatic control of the control unit 60 (see FIG. 4) or from the first state S1 to the second state S2 by the manual operation of the operator. In FIG. 12, a case where the state of the electrolytic apparatus 200 is changed from the first state S1 to the second state S2 by the automatic control of the control unit 60 is indicated as automatic response, and a case where the state is changed from the first state S1 to the second state S2 by the manual operation of the operator is indicated as manual response.

When the determination result acquisition unit 40 (see FIG. 4) acquires the determination result 41 in which it is determined that the state of the electrolytic apparatus 200 is the first state S1 in the determination result acquisition step S206, in the display step S207, the display unit 50 may further display a procedure for changing the state from the first state S1 to the second state S2 by the control unit 60 automatically controlling the electrolytic apparatus 200.

In the determination step S224, the control unit 60 (see FIG. 4) may determine whether to change the state of the electrolytic apparatus 200 from the first state S1 to the second state S2 by the automatic control or from the first state S1 to the second state S2 by the manual operation of the operator. When it is determined in the determination step S224 that the automatic control is to be performed, the operation support method proceeds to the determination step S226. When it is determined in determination step S224 that the manual operation of the operator is to be performed, the operation support method proceeds to determination step S228.

The determination step S226 is a step of determining whether a preparation for changing the state of the electrolytic apparatus 200 from the first state S1 to the second state S2 by the automatic control is completed. In the determination step S226, the control unit 60 (see FIG. 4) may determine whether the preparation is completed. When it is determined in the determination step S226 that the preparation is completed, the operation support method proceeds to an automatic response step S230. When it is determined in the determination step S226 that the preparation is not completed, the operation support method may wait until the preparation is completed in the determination step S226.

The automatic response step S230 is a step of changing the state of the electrolytic apparatus 200 from the first state S1 to the second state S2 by the automatic control. In the automatic response step S230, the control unit 60 (see FIG. 4) may change the state of the electrolytic apparatus 200 from the first state S1 to the second state S2 by the automatic control. The operation support method may return to the determination result acquisition step S206 after the automatic response step S230. In the determination result acquisition step S206, the determination result 41 obtained by determining whether the state of the electrolytic apparatus 200 is the second state S2 in the automatic response step S230 may be acquired.

The determination step S228 is a step of determining whether the current procedure P selected in the selection step S218 is sufficient when the state of the electrolytic apparatus 200 is manually changed from the first state S1 to the second state S2 by the operator. In the determination step S228, the control unit 60 (see FIG. 4) may determine whether the procedure P is sufficient.

In the determination step S228, when it is determined that there is no problem with the current procedure P selected in the selection step 218, the operator may perform the work for changing the state of the electrolytic apparatus 200 from the first state S1 to the second state S2 according to the procedure P. When it is determined in determination step S228 that there is a problem in the current procedure P selected in selection step S218, the operation support method may proceed to the selection step S218. In the selection step S218, another procedure P different from the procedure P may be selected.

The operation support method may further include a work end accepting step S232. The work end accepting step S232 is a step in which the control unit 60 (see FIG. 4) accepts the end of the work by the operator. When the control unit 60 accepts the end of the work by the operator in the work end accepting step S232, in the determination result acquisition step S206, the determination result acquisition unit 40 (see FIG. 4) may further acquire the result obtained by determining whether the state of the electrolytic apparatus 200 is transitionable from the first state S1 to the second state S2 by the work by the operator.

Even when the control unit 60 accepts the end of the work by the operator, there is a case where the electrolytic apparatus 200 is not transitionable from the first state S1 to the second state S2 due to the work mistake of the operator or the like. Thus, the determination result acquisition unit 40 may further acquire the result obtained by determining whether the electrolytic apparatus 200 is in the state of being transitionable from the first state S1 to the second state S2 by the work by the operator. Note that the operator may be a human or may be a robot controlled by artificial intelligence (AI).

Figure 13:
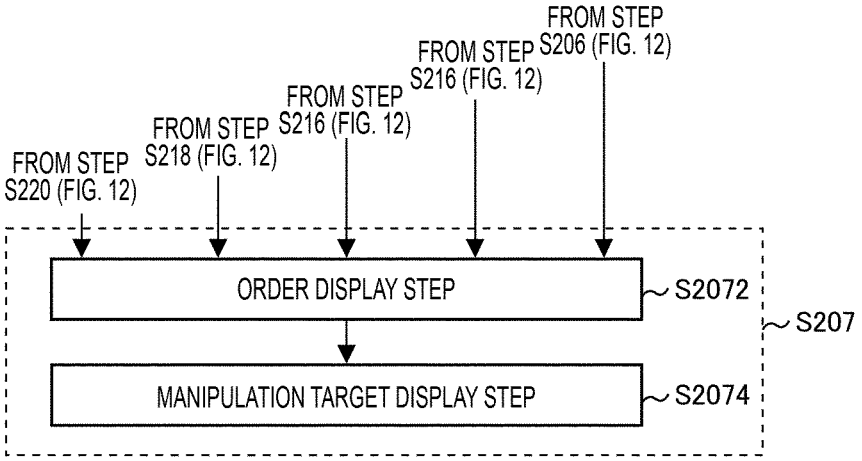
FIG. 13 is a flowchart showing an example of details of a display step S207 in FIG. 12.

FIG. 13 is a flowchart showing an example of details of the display step S207 in FIG. 12. The display step S207 may include an order display step S2072 and a manipulation target display step S2074. The order display step S2072 is a step in which the display unit 50 displays the manipulation order of the manual manipulation target switching portion 660 (see FIG. 1).

The order display step S2072 may be a step after either of the selection step S218 or the storage step S220 when it is determined in the determination result acquisition step S206 and the determination step S216 in FIG. 12 that the elapsed time T>the allowable time Tth, and when it is determined in the determination step S216 that the elapsed time T the allowable time Tth.

Describing the example of FIG. 6, in the example shown in FIG. 6, the order display step S2072 is a step in which the manipulation order of the three manual manipulation target switching portion 660 is indicated by the circled numbers 1 to 3. In the order display step S2072, the manipulation order of the manual manipulation target switching portion 660 is displayed on the display unit 50, so that the operator can easily manipulate the manual manipulation target switching portion 660.

The operation support method may proceed to the manipulation target display step S2074 after the order display step S2072. The manipulation target display step S2074 is a step in which the display unit 50 sequentially displays the manual manipulation target switching portion 660, which is the current manipulation target, on the basis of the manipulation order.

Describing the example of FIG. 6, in the example shown in FIG. 6, the control unit 60 (see FIG. 4) may control the display unit 50 to sequentially display the manual manipulation target switching portion 660 which is the current manipulation target, for example, by causing the broken line frame surrounding the manual manipulation target switching portion 660 which is the current manipulation target among the three manual manipulation target switching portions 660 indicated by the broken line frames to blink. As a result, the operator is less likely to erroneously manipulate the manual manipulation target switching portion 660 which is not the current manipulation target.

Figure 14:
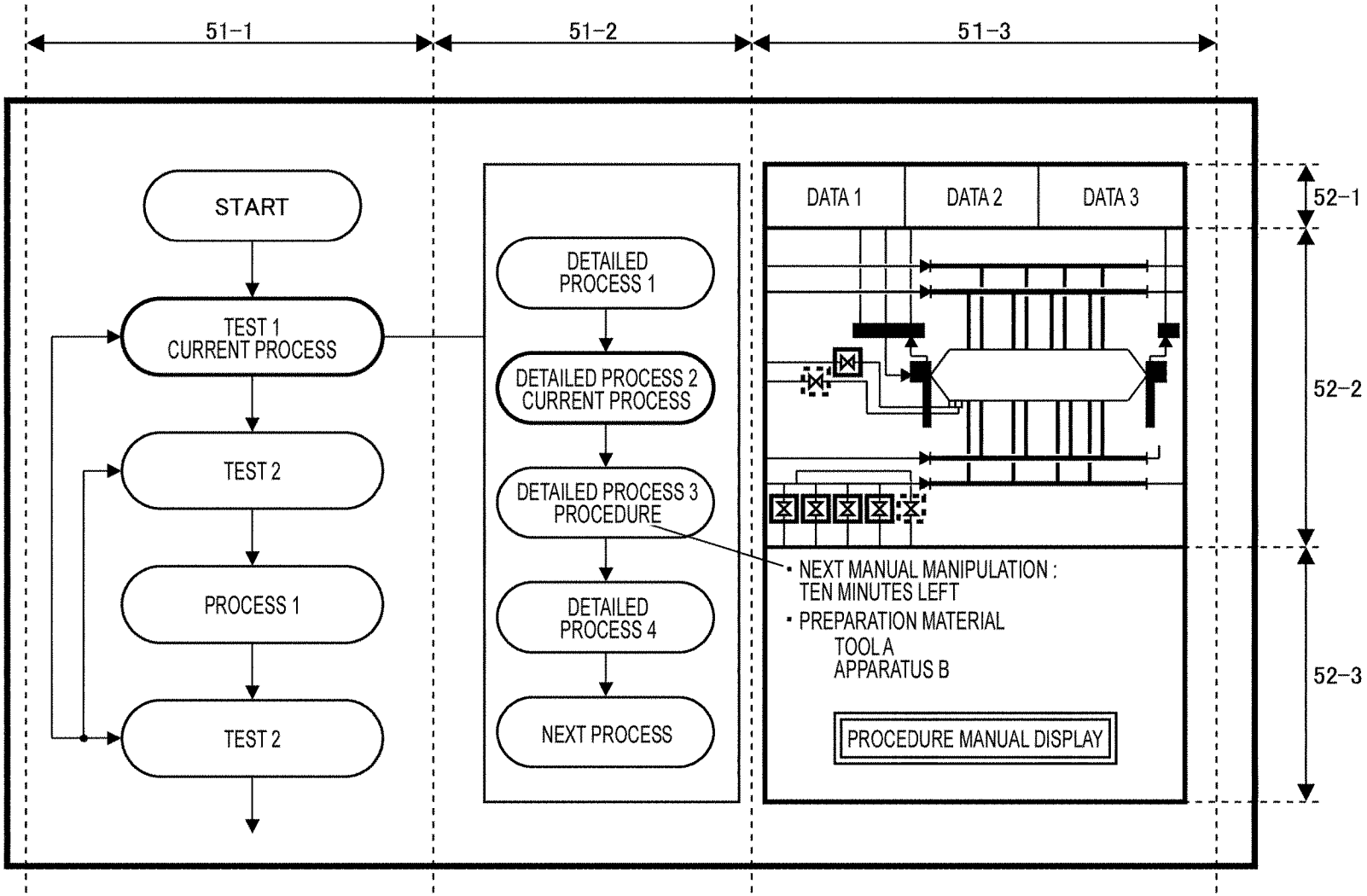
FIG. 14 shows another example of the display unit 50.

FIG. 14 shows another example of the display unit 50. The display unit 50 is, for example, a monitor, a display, or the like. When the operation support device 100 is a tablet computer, the display unit 50 may be the display of the tablet computer. The display unit 50 of the present example includes three display regions 51 (a display region 51-1, a display region 51-2, and a display region 51-3).

In the present example, a first flowchart shown in FIG. 11 is shown in the display region 51-1, and a second flowchart shown in FIG. 12 is shown in the display region 51-2. The flowchart shown in FIG. 13 may be further shown in the display region 51-2. In the present example, the display region 51-3 shows the display region 52-1 to the display region 52-3 shown in FIGS. 5 to 10.

In the present example, steps S100 to S120 shown in FIG. 11 are shown in a simplified manner in the display region 51-1. In a state where the operation support device 100 is in operation, a current process among the processes shown in the display region 51-1 may be indicated by a thick line frame.

In the present example, steps S200 to S230 shown in FIG. 12 are shown in a simplified manner in the display region 51-2. In the display region 51-2, the detailed process of the current process in the display region 51-1 may be shown. In a state where the operation support device 100 is in operation, a current process among the processes shown in the display region 51-1 may be indicated by a thick line frame.

In the present example, in the display region 51-3, the state of the electrolytic apparatus 200 (see FIG. 1) corresponding to the display region 51-1 and the display region 51-2 is visually shown. FIG. 14 is an example of a display manner of the display unit 50 in a case where the determination result acquisition unit 40 (see FIG. 4) acquires the determination result 41 that it is determined that the electrolytic apparatus 200 (see FIG. 1) is currently in the second state S2 (normal state) and in a case where predetermined work by the operator is required in the next process.

Figure 15:
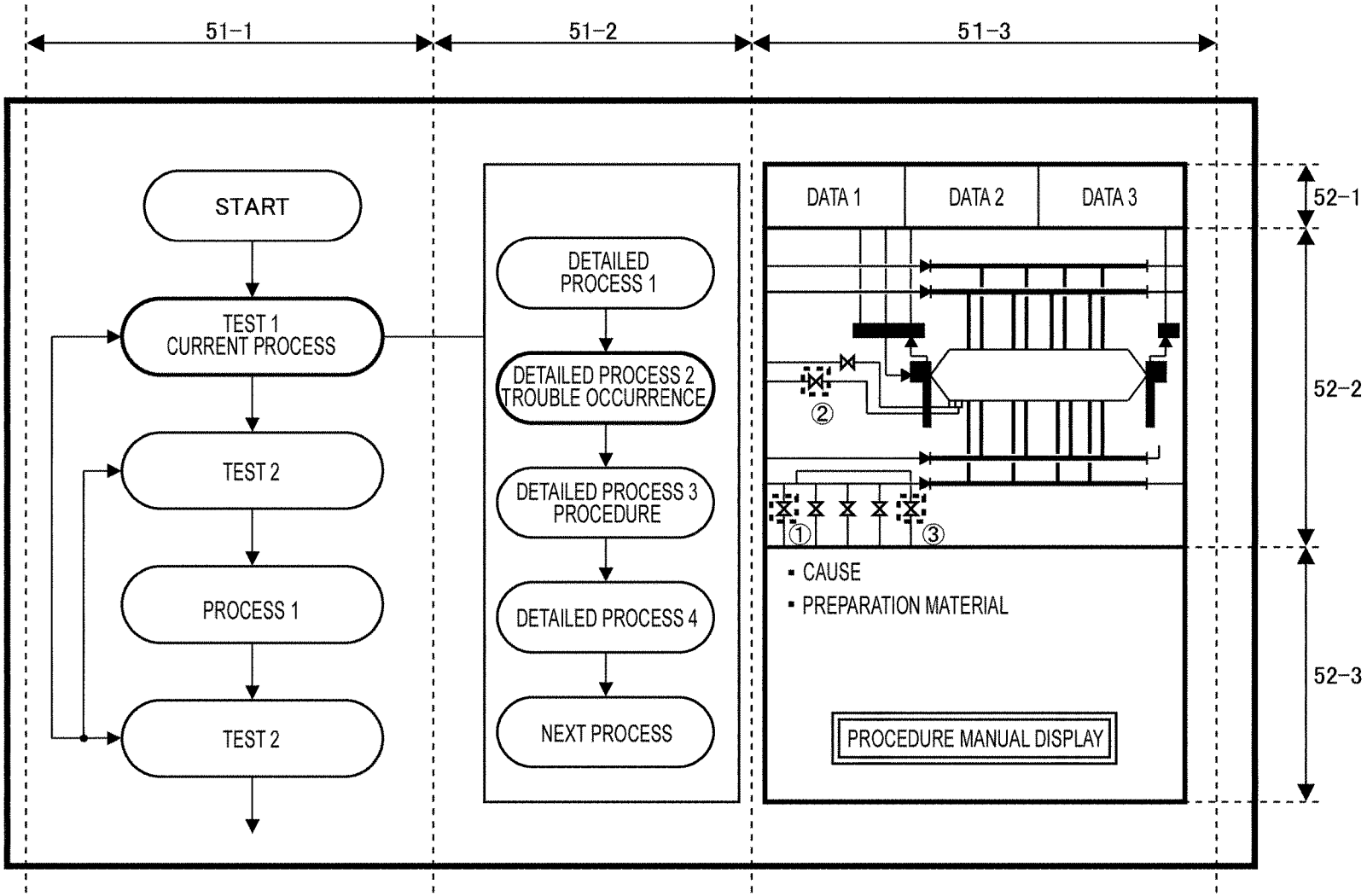
FIG. 15 shows still another example of the display unit 50.

FIG. 15 shows another example of the display unit 50. FIG. 15 is an example of the display by the display unit 50 when a trouble currently occurs in the electrolytic apparatus 200. A button for causing a procedure manual which is a procedure manual for coping with the trouble and indicates the procedure of the work by the operator to be displayed may be displayed in the display region 51-3 in the display region 52-3.

Figure 16:
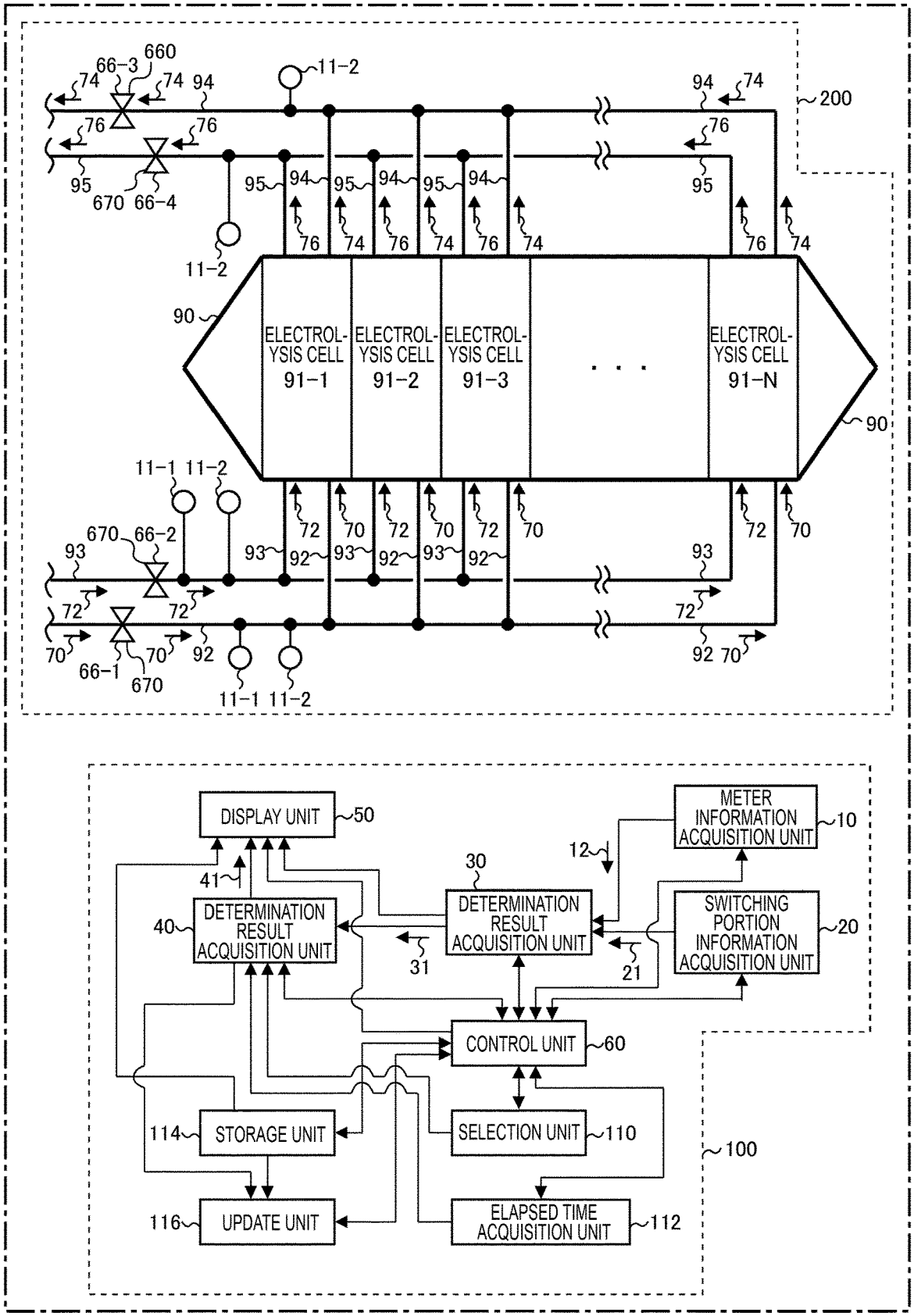
FIG. 16 shows an example of an operation support system 300 according to one embodiment of the present invention.

FIG. 16 shows an example of the operation support system 300 according to one embodiment of the present invention. The operation support system 300 includes the operation support device 100 and the electrolytic apparatus 200.

In the operation support system 300 of the present example, the instrument information acquisition unit 10 in the operation support device 100 acquires the instrument information 12 from the instrument 11 of the electrolytic apparatus 200. In the operation support system 300 of the present example, the switching portion information acquisition unit 20 in the operation support device 100 acquires the switching portion information 21 indicating the information regarding the switching portion 66 included in the electrolytic apparatus 200. In the operation support system 300 of the present example, the electrolytic apparatus state acquisition unit 30 in the operation support device 100 acquires the electrolytic apparatus state information 31 indicating the state of the electrolytic apparatus 200.

Various embodiments of the present invention may also be described with reference to flowcharts and block diagrams. In the various embodiments of the invention, the blocks may represent (1) a stage of a process in which an operation is performed or (2) a section of a device that is responsible for performing the operation.

Specific stages may be implemented by a dedicated circuit, a programmable circuit, or a processor. Specific sections may be implemented by a dedicated circuit, a programmable circuit, or a processor. The programmable circuit and the processor may be supplied together with a computer-readable instruction. The computer-readable instruction may be stored on a computer-readable medium.

The dedicated circuit may include at least one of a digital hardware circuit or an analog hardware circuit. The dedicated circuit may include at least one of an integrated circuit (IC) or a discrete circuit. The programmable circuit may include a hardware circuit for logical AND, logical OR, logical XOR, logical NAND, logical NOR, or other logical operations. The programmable circuit may include a reconfigurable hardware circuit which includes memory elements such as flip-flops, registers, field programmable gate arrays (FPGA), and programmable logic arrays (PLA), or the like.

The computer-readable medium may include any tangible device capable of storing instructions for execution by an appropriate device. When the computer-readable medium may include such tangible device, the computer-readable medium having instructions stored in the device includes a product including instructions that can be executed in order to create means for executing the operations designated in the flowcharts or block diagrams.

The computer-readable medium may be, for example, an electronic storage medium, a magnetic storage medium, an optical storage medium, an electromagnetic storage medium, a semiconductor storage medium, and the like. More specifically, the computer-readable medium may be, for example, a floppy (registered trademark) disk, a diskette, a hard disk, a random access memory (RAM), a read-only memory (ROM), an erasable programmable read-only memory (EPROM or flash memory), an electrically erasable programmable read-only memory (EEPROM), a static random access memory (SRAM), a compact disc read-only memory (CD-ROM), a digital versatile disk (DVD), a Blu-Ray (registered trademark) disk, a memory stick, an integrated circuit card, or the like.

The computer-readable instruction may include either of an assembler instruction, an instruction set architecture (ISA) instruction, a machine instruction, a machine dependent instruction, a microcode, a firmware instruction, state-setting data, a source code, or an object code. The source code and the object code may be written in any combination of one or more programming languages including an object oriented programming language and a conventional procedural programming language. For example, the object oriented programming language may be Smalltalk (registered trademark), JAVA (registered trademark), C++, or the like. For example, the procedural programming language may be a "C" programming language.

The computer-readable instruction may be provided for a processor of a general-purpose computer, a special purpose computer, or another programmable data processing apparatus, or a programmable circuit locally or via a local area network (LAN) or a wide area network (WAN) such as the Internet. The processor of the general-purpose computer, the special purpose computer, or another programmable data processing apparatus, or the programmable circuit may execute the computer-readable instruction to create means for executing the operations designated in the flowcharts shown in FIGS. 11 to 13 or block diagram shown in FIG. 4. For example, the processor may be a computer processor, a processing unit, a microprocessor, a digital signal processor, a controller, a microcontroller, or the like.

Figure 17:
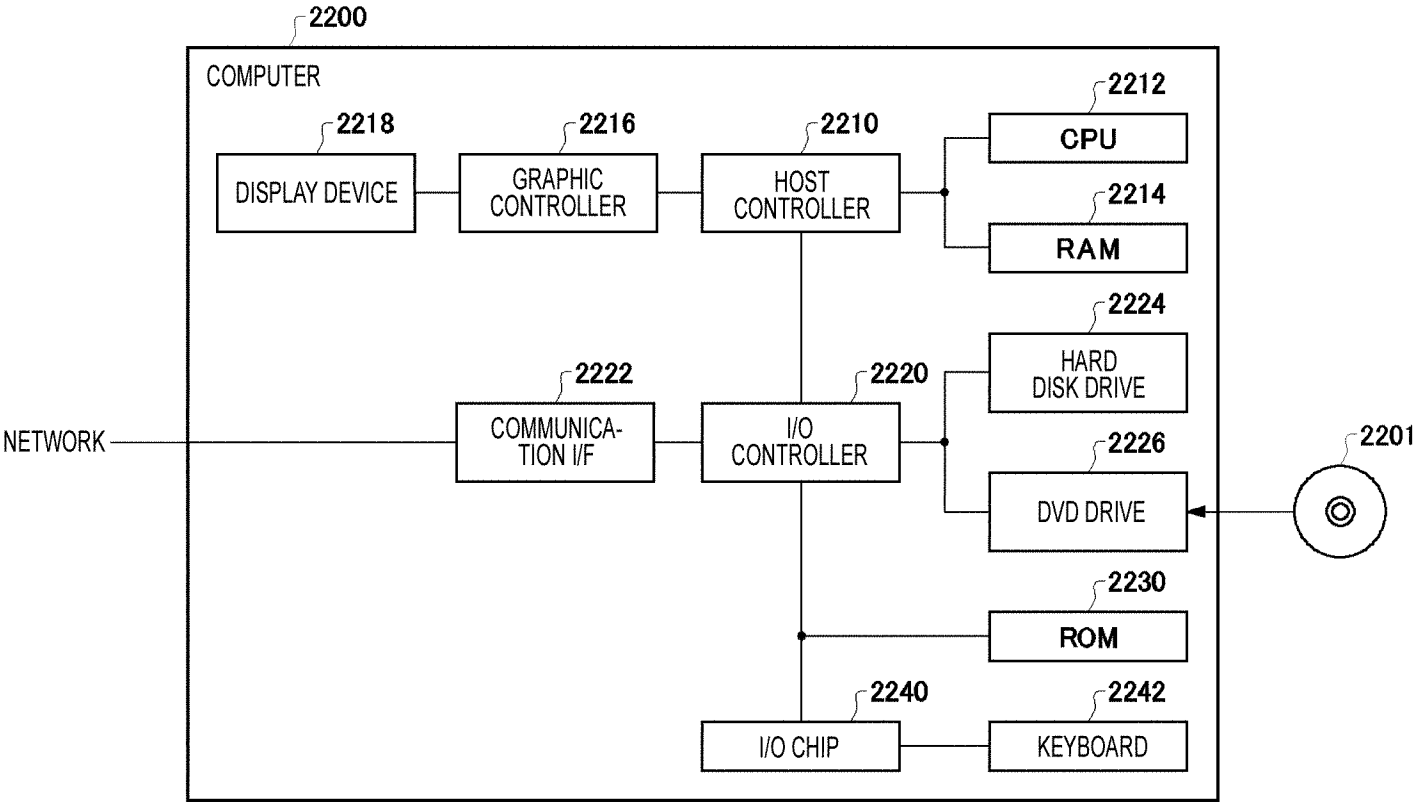
FIG. 17 shows an example of a computer 2200 in which the operation support device 100 of the present invention may be embodied in whole or in part.

FIG. 17 shows an example of a computer 2200 in which the operation support device 100 according to the embodiment of the present invention may be embodied in whole or in part. A program installed in the computer 2200 can cause the computer 2200 to function as an operation associated with the operation support device 100 according to the embodiment of the present invention or one or more sections of the operation support device 100, or can cause the operation or the one or more sections to be executed, or can cause the computer 2200 to execute each stage (see FIGS. 11 to 13) according to the operation support method of the present invention. The program may be executed by a CPU 2212 to cause the computer 2200 to perform certain operations associated with some or all of the blocks in the flowcharts (FIGS. 11 to 13) and the block diagram (FIG. 4) described in the present specification.

The computer 2200 according to the present embodiment includes the CPU 2212, a RAM 2214, a graphic controller 2216, and a display device 2218. The CPU 2212, the RAM 2214, the graphic controller 2216, and the display device 2218 are mutually connected by a host controller 2210. The computer 2200 further includes an input/output unit such as a communication interface 2222, a hard disk drive 2224, a DVD-ROM drive 2226, and an IC card drive. The communication interface 2222, the hard disk drive 2224, the DVD-ROM drive 2226, the IC card drive, and the like are connected to the host controller 2210 via an input/output controller 2220. The computer further includes a legacy input/output unit such as a ROM 2230 and a keyboard 2242. The ROM 2230, the keyboard 2242, and the like are connected to the input/output controller 2220 via an input/output chip 2240.

The CPU 2212 operates according to the programs stored in the ROM 2230 and the RAM 2214, thereby controlling each unit. The graphics controller 2216 acquires the image data generated by the CPU 2212 in a frame buffer or the like provided in the RAM 2214 or in the RAM 2214 and causes the image data to be displayed on the display device 2218.

The communication interface 2222 communicates with other electronic devices via a network. The hard disk drive 2224 stores programs and data used by the CPU 2212 in the computer 2200. The DVD-ROM drive 2226 reads a program or data from a DVD-ROM 2201 and provides the read program or data to the hard disk drive 2224 via the RAM 2214. The IC card drive reads a program and data from an IC card or writes a program and data into the IC card.

The ROM 2230 stores a boot programs or the like executed by the computer 2200 at the time of activation or a program depending on the hardware of the computer 2200. The input/output chip 2240 may also connect various input/output units to the input/output controller 2220 via a parallel port, a serial port, a keyboard port, a mouse port, or the like.

The program is provided by a computer-readable medium such as the DVD-ROM 2201 or the IC card. The program is read from a computer-readable medium, installed in the hard disk drive 2224, the RAM 2214, or the ROM 2230 which is also an example of the computer-readable medium, and executed by the CPU 2212. The information processing described in these programs is read by the computer 2200 and provides cooperation between the programs and various types of hardware resources. The device or method may be configured by implementing operations or processing of information according to use of the computer 2200.

For example, when communication is performed between the computer 2200 and an external device, the CPU 2212 may execute a communication program loaded in the RAM 2214 and instruct the communication interface 2222 to perform communication processing based on the processing described in the communication program. Under the control of the CPU 2212, the communication interface 2222 reads transmission data stored in a transmission buffer processing area provided in a recording medium such as the RAM 2214, the hard disk drive 2224, the DVD-ROM 2201, or the IC card, transmits the read transmission data to the network, or writes reception data received from the network in a reception buffer processing area or the like provided on the recording medium.

The CPU 2212 may cause the RAM 2214 to read all or a necessary portion of a file or a database stored in an external recording medium such as the hard disk drive 2224, the DVD-ROM drive 2226 (DVD-ROM 2201), or the IC card. The CPU 2212 may execute various types of processing on data on the RAM 2214. Next, the CPU 2212 may write back the processed data to the external recording medium.

Various types of information such as various types of programs, data, tables, and databases may be stored in a recording medium and subjected to information processing. The CPU 2212 may execute various types of processing, which is described in the present disclosure and includes various types of operations designated by an instruction sequence of a program, information processing, condition determination, conditional branching, unconditional branching, information retrieval/replacement, and the like, on the data read from the RAM 2214. The CPU 2212 may writes back the results to the RAM 2214.

The CPU 2212 may search for information in a file, a database, or the like in the recording medium. For example, when a plurality of entries each having the attribute value of a first attribute associated with the attribute value of a second attribute is stored in the recording medium, the CPU 2212 may search the plurality of entries for an entry matching a condition in which the attribute value of the first attribute is designated, read the attribute value of the second attribute stored in the entry, read the second attribute value, and thus acquire the attribute value of the second attribute associated with the first attribute satisfying a predetermined condition.

The programs or software modules described above may be stored in a computer-readable medium on the computer 2200 or near the computer 2200. A recording medium such as a hard disk or a RAM provided in a server system connected to a dedicated communication network or the Internet can be used as the computer-readable medium. The program may be provided to the computer 2200 by the recording medium.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCES

10: instrument information acquisition unit; 11: instrument; 12: instrument information; 20: switching portion information acquisition unit; 21: switching portion information; 30: electrolytic apparatus state acquisition unit; 31: electrolytic apparatus state information; 40:

determination result acquisition unit; 41: determination result; 50: display unit; 51: display region; 52: display region; 60: control unit; 66: switching portion; 70: liquid; 71: cation; 72: liquid; 73: liquid; 74: liquid; 75: liquid; 76: liquid; 77: gas; 78: gas; 79: anode chamber; 80: anode; 81: bottom surface; 82: cathode; 83: inner side surface; 84: ion exchange membrane; 85: ceiling surface; 86: anion group; 90: electrolyzer; 91: electrolysis cell; 92: introduction tube; 93: introduction tube; 94: discharge tube; 95: discharge tube; 98: cathode chamber; 100: operation support device; 110: selection unit; 112: elapsed time acquisition unit; 114: storage unit; 116: update unit; 200: electrolytic apparatus; 300: operation support system; 660: manual manipulation target switching portion; 670: automatic control target switching portion; 2200: computer; 2201: DVD-ROM; 2210: host controller; 2212: CPU; 2214: RAM; 2216: graphic controller; 2218: display device; 2220: input/output controller; 2222: communication interface; 2224: hard disk drive; 2226: DVD-ROM drive; 2230: ROM; 2240: input/output chip; and 2242: keyboard

What is claimed is:

1. An operation support method for supporting an operation of an electrolytic apparatus, the operation support method comprising:

acquiring, by an instrument information acquisition unit, from an instrument included in the electrolytic apparatus, instrument information including measurement data which is measurement data by the instrument and is obtained by measuring a parameter regarding the electrolytic apparatus;

acquiring, by a switching portion information acquisition unit, switching portion information indicating information regarding one or more switching portions which are included in the electrolytic apparatus and configured to control at least one of a flow rate of a fluid or a pressure of gas;

acquiring, by an electrolytic apparatus state acquisition unit, electrolytic apparatus state information indicating a state of the electrolytic apparatus on a basis of at least one of the instrument information or the switching portion information;

acquiring, by a determination result acquisition unit, when the electrolytic apparatus state information is in a predetermined second condition, a determination result that it is determined that the state of the electrolytic apparatus is a second state, the second state being a state in which a control unit automatically controls the switching portion; and displaying, by the control unit, the electrolytic apparatus state information acquired in the acquiring of the electrolytic apparatus state and the determination result acquired in the acquiring of the determination result;

wherein the acquiring of the determination result is a step in which the determination result acquisition unit acquires a determination result that it is determined that the state of the electrolytic apparatus is a first state where the control unit is to prompt a work by an operator when the electrolytic apparatus state information is in a predetermined first condition different from the second condition or a determination result that it is determined that the state of the electrolytic apparatus is the second state when the electrolytic apparatus state information is in the second condition;

wherein when the determination result acquisition unit acquires the determination result that it is determined that the state of the electrolytic apparatus is the first state in the acquiring of the determination result, in the displaying, the control unit is configured to further display a procedure for changing the state from the first state to the second state; and wherein the acquiring of the determination result is a step in which the determination result acquisition unit acquires a determination result obtained by further determining whether the state of the electrolytic apparatus has changed from the first state to the second state according to the procedure, the operation support method further comprising acquiring, by an elapsed time acquisition unit, an elapsed time for which the first state continues after the determination result that the state of the electrolytic apparatus is the first state is acquired in the acquiring of the determination result.

2. The operation support method according to claim 1, wherein the electrolytic apparatus state information includes information indicating that the electrolytic apparatus is in a normal state or an abnormal state, or process information indicating which process the electrolytic apparatus is in.

3. The operation support method according to claim 1, wherein the displaying is a step in which the control unit displays the electrolytic apparatus state information and the determination result that it is determined that the state of the electrolytic apparatus is the first state or the determination result that it is determined that the state of the electrolytic apparatus is the second state.

4. The operation support method according to claim 3, wherein the first state includes an abnormal state where the state of the electrolytic apparatus is abnormal.

5. The operation support method according to claim 3, wherein the displaying is a step in which the control unit controls a display unit to display the electrolytic apparatus state information and the determination result that it is determined that the state of the electrolytic apparatus is the first state or the determination result that it is determined that the state of the electrolytic apparatus is the second state.

6. The operation support method according to claim 1, wherein the work by the operator includes at least any one of a manipulation of a manual manipulation target switching portion for which the operator manually manipulates the switching portion, confirmation for the electrolytic apparatus, or confirmation for components of the electrolytic apparatus.

7. The operation support method according to claim 6, wherein in the displaying, the control unit is configured to separately display the manual manipulation target switching portion for which the operator manually manipulates the switching portion, and one or more automatic control target switching portions which are targets of automatic control in the electrolytic apparatus.

8. The operation support method according to claim 7, wherein the displaying further includes displaying, by the control unit, a manipulation order of the manual manipulation target switching portion.

9. The operation support method according to claim 8, wherein the displaying further includes displaying a manipulation target in which the control unit sequentially displays the manual manipulation target switching portion, which is a current manipulation target, on a basis of the manipulation order.

10. The operation support method according to claim 8, further comprising, when the determination result acquisition unit acquires a determination result that it is determined that the state of the electrolytic apparatus is an abnormal state in the acquiring of the determination result, locking, by the control unit, at least one of the switching portions to be in a fixed state, to be unmanipulable, or to be unopenable.

11. The operation support method according to claim 10, wherein when the control unit locks at least one of the one or more switching portions in the locking, in the displaying, the control unit is configured to display the switching portion, which is set to be in the fixed state, to be unmanipulable, or to be unopenable, separately from other switching portions.

12. The operation support method according to claim 1, wherein when it is determined that the elapsed time acquired by the elapsed time acquisition unit in the acquiring of the elapsed time is longer than a predetermined allowable time, in the displaying, the control unit is configured to further display another procedure different from the procedure.

13. The operation support method according to claim 12, further comprising selecting, by a selection unit, a procedure, which corresponds to a type of the first state, for changing the state from the first state to the second state.

14. The operation support method according to claim 13, wherein the acquiring of the determination result is a step in which the determination result acquisition unit acquires a result obtained by further determining whether the state of the electrolytic apparatus has changed from the first state to the second state according to the procedure selected in the selecting, and in the displaying, the control unit is configured to further display another procedure different from the procedure selected in the selecting.

15. The operation support method according to claim 14, wherein when the determination result acquisition unit acquires a determination result that it is determined that the state of the electrolytic apparatus is the first state in the acquiring of the determination result, in the displaying, the control unit is configured to display the type of the first state, the procedure corresponding to the type of the first state, and the another procedure.

16. The operation support method according to claim 15, wherein the acquiring of the determination result is a step in which the determination result acquisition unit acquires a result obtained by determining whether the state of the electrolytic apparatus is the first state or the second state on a basis of a predetermined standard, the operation support method further comprising updating, by an update unit, the predetermined standard on a basis of the procedure and the elapsed time.

17. The operation support method according to claim 1, further comprising accepting, by the control unit, end of the work by the operator, wherein in a case where the determination result acquisition unit acquires a determination result that it is determined that the state of the electrolytic apparatus is the first state in the acquiring of the determination result, when the control unit accepts the end of the work by the operator in the accepting the end of the work, the determination result acquisition unit is configured to further acquire a result obtained by determining whether the state of the electrolytic apparatus is transitionable from the first state to the second state by the work by the operator.

18. A non-transitory computer-readable medium having recorded thereon an operation support program that, when executed by a computer, causes the computer to perform operations comprising:

acquiring, from an instrument included in an electrolytic apparatus, instrument information including measurement data which is measurement data by the instrument and is obtained by measuring a parameter regarding the electrolytic apparatus;

acquiring switching portion information indicating information regarding one or more switching portions which are included in the electrolytic apparatus and configured to control at least one of a flow rate of a fluid or a pressure of gas;

acquiring electrolytic apparatus state information indicating a state of the electrolytic apparatus on a basis of at least one of the instrument information or the switching portion information;

acquiring, when the electrolytic apparatus state information is in a predetermined second condition, a determination result that it is determined that the state of the electrolytic apparatus is a second state, the second state being a state in which a control unit automatically controls the switching portion; and displaying the electrolytic apparatus state information acquired in the acquiring of the electrolytic apparatus state and the determination result acquired in the acquiring of the determination result;

wherein the acquiring of the determination result includes acquiring a determination result that it is determined that the state of the electrolytic apparatus is a first state where the control unit is to prompt a work by an operator when the electrolytic apparatus state information is in a predetermined first condition different from the second condition or a determination result that it is determined that the state of the electrolytic apparatus is the second state when the electrolytic apparatus state information is in the second condition;

wherein when the determination result is acquired a determination result that it is determined that the state of the electrolytic apparatus is the first state in the acquiring of the determination result, in the displaying, the control unit is configured to further display a procedure for changing the state from the first state to the second state; and wherein the acquiring of the determination result includes acquiring a determination result obtained by further determining whether the state of the electrolytic apparatus has changed from the first state to the second state according to the procedure, the operation support method further comprising acquiring an elapsed time for which the first state continues after the determination result that the state of the electrolytic apparatus is the first state is acquired in the acquiring of the determination result.

19. An operation support device configured to support an operation of an electrolytic apparatus, the operation support device comprising:

an instrument information acquisition unit configured to acquire, from an instrument included in the electrolytic apparatus, instrument information including measurement data which is measurement data by the instrument and is obtained by measuring a parameter regarding the electrolytic apparatus;

a switching portion information acquisition unit configured to acquire switching portion information indicating information regarding one or more switching portions which are included in the electrolytic apparatus and configured to control at least one of a flow rate of a fluid or a pressure of gas;

an electrolytic apparatus state acquisition unit configured to acquire electrolytic apparatus state information indicating a state of the electrolytic apparatus on a basis of at least one of the instrument information or the switching portion information;

a determination result acquisition unit configured to acquire, when the electrolytic apparatus state information is in a predetermined second condition, a determination result that it is determined that the state of the electrolytic apparatus is a second state, the second state being a state in which a control unit automatically controls the switching portion; and the control unit configured to display the electrolytic apparatus state information acquired by the electrolytic apparatus state acquisition unit and the determination result acquired by the determination result acquisition unit;

wherein the determination result acquisition unit acquires a determination result that it is determined that the state of the electrolytic apparatus is a first state where the control unit is to prompt a work by an operator when the electrolytic apparatus state information is in a predetermined first condition different from the second condition or a determination result that it is determined that the state of the electrolytic apparatus is the second state when the electrolytic apparatus state information is in the second condition;

wherein when the determination result acquisition unit acquires the determination result that it is determined that the state of the electrolytic apparatus is the first state in the acquiring of the determination result, in the displaying, the control unit is configured to further display a procedure for changing the state from the first state to the second state; and wherein the determination result acquisition unit acquires a determination result obtained by further determining whether the state of the electrolytic apparatus has changed from the first state to the second state according to the procedure, the operation support method further comprising acquiring, by an elapsed time acquisition unit, an elapsed time for which the first state continues after the determination result that the state of the electrolytic apparatus is the first state is acquired in the acquiring of the determination result.

20. The operation support device according to claim 19, wherein the electrolytic apparatus state information includes information indicating that the electrolytic apparatus is in a normal state or an abnormal state, or process information indicating which process the electrolytic apparatus is in.

21. The operation support device according to claim 19, wherein the control unit is configured to display the electrolytic apparatus state information and the determination result that it is determined that the state of the electrolytic apparatus is the first state or the determination result that it is determined that the state of the electrolytic apparatus is the second state.

22. The operation support device according to claim 21, wherein the control unit is configured to control a display unit to display the electrolytic apparatus state information and the determination result that it is determined that the state of the electrolytic apparatus is the first state or the determination result that it is determined that the state of the electrolytic apparatus is the second state.

23. An operation support system comprising: the operation support device according to claim 19; and the electrolytic apparatus.

* * * * *